US006846604B2

(12) United States Patent
Emoto et al.

(10) Patent No.: US 6,846,604 B2
(45) Date of Patent: Jan. 25, 2005

(54) TONER AND IMAGE FORMING APPARATUS USING THE TONER

(75) Inventors: Shigeru Emoto, Numazu (JP); Hiroshi Yamashita, Numazu (JP); Naohiro Watanabe, Suntoh-gun (JP); Tsunemi Sugiyama, Numazu (JP); Hiroshi Yamada, Numazu (JP); Masami Tomita, Numazu (JP)

(73) Assignee: Ricoh Company Limited, Tokyo (JP)

( * ) Notice: Subject to any disclaimer, the term of this patent is extended or adjusted under 35 U.S.C. 154(b) by 0 days.

(21) Appl. No.: 10/246,601

(22) Filed: Sep. 19, 2002

(65) Prior Publication Data

US 2003/0134220 A1 Jul. 17, 2003

(30) Foreign Application Priority Data

Sep. 19, 2001 (JP) ..... 2001-285326

(51) Int. Cl.[7] ..... G03G 9/08; G03G 15/20

(52) U.S. Cl. ..... 430/110.3; 430/110.4; 430/137.15; 399/320

(58) Field of Search ..... 430/110.3, 110.4, 430/109.4, 137.15, 110.1; 399/320

(56) References Cited

U.S. PATENT DOCUMENTS

| | | | | |
|---|---|---|---|---|
| 5,915,150 A | * | 6/1999 | Kukimoto et al. | 399/149 |
| 6,103,441 A | | 8/2000 | Tomita et al. | |
| 6,255,028 B1 | | 7/2001 | Hasegawa et al. | |
| 6,335,137 B1 | | 1/2002 | Suzuki et al. | |
| 6,360,068 B1 | | 3/2002 | Kinoshita et al. | |
| 6,363,229 B1 | | 3/2002 | Shiraishi et al. | |
| 6,395,443 B2 | | 5/2002 | Kuroda et al. | |
| 6,403,275 B1 | | 6/2002 | Kuramoto et al. | |
| 6,416,914 B1 | * | 7/2002 | Nakamura et al. | 430/31 |
| 6,416,917 B1 | * | 7/2002 | Nakanishi et al. | 430/109.2 |
| 6,432,589 B1 | | 8/2002 | Uchinokura et al. | |
| 6,503,676 B2 | * | 1/2003 | Yamashita et al. | 430/108.3 |
| 2002/0025184 A1 | * | 2/2002 | Ishikawa et al. | 399/111 |

FOREIGN PATENT DOCUMENTS

| | | |
|---|---|---|
| EP | 1 026 554 | 8/2000 |
| EP | 1 096 324 | 5/2001 |
| JP | 5-34979 | 2/1993 |
| JP | 8-44111 | 2/1996 |
| JP | 8-286414 | 11/1996 |
| JP | 9-15903 | 1/1997 |
| JP | 11-149177 | 6/1999 |
| JP | 11-149180 | 6/1999 |

* cited by examiner

*Primary Examiner*—John L Goodrow
(74) *Attorney, Agent, or Firm*—Oblon, Spivak, McClelland, Maier & Neustadt, P.C.

(57) ABSTRACT

A toner composition including toner particles including mother toner particles, which include a binder resin, a colorant and a release agent, and a charge controlling agent which is located on a surface of the mother toner particles and fixed thereon, wherein the toner particles have a spherical degree of from 0.960 to 1.000 and a specific surface area of from 0.70 to 2.5 $m^2/g$. The toner composition optionally includes an external additive which is present on the surface of the toner particles.

21 Claims, 2 Drawing Sheets

TONER AND IMAGE FORMING APPARATUS USING THE TONER

BACKGROUND OF THE INVENTION

1. Field of the Invention

The present invention relates to a toner for use in a developer developing an electrostatic latent image formed by electrophotography, electrostatic recording, electrostatic printing or the like and to an image forming apparatus using the toner.

More particularly, the present invention relates to a toner for use in image forming apparatus such as copiers, laser printers and plain paper facsimile machines, which use a direct or indirect electrophotographic image forming method, and to a developer and an image forming apparatus using the toner.

In addition, the present invention also relates to a color toner for use in full color image forming apparatus such as color copiers, full color laser printers and full color facsimile machines, which use a direct or indirect electrophotographic developing method, and to a developer and an image forming apparatus using the color toner.

Further, the present invention relates to a toner for use in an electrophotographic full color image forming method in which a toner image formed on an image bearing member is first transferred on an intermediate transfer medium and the toner image on the intermediate transfer medium is second transferred on a receiving material, and to a method for manufacturing the toner and an image forming apparatus using the toner.

2. Discussion of the Background

Image forming methods in which an electrostatic latent image is visualized utilizing electrophotography, electrostatic recording or the like method are used for various fields.

For example, image forming methods using electrophotography include the following processes:

(1) a photoreceptor is charged (charging process);
(2) imagewise light irradiates the photoreceptor to form an electrostatic latent image thereon (light irradiating process);
(3) the electrostatic latent image is developed with a developer including a toner to form a toner image on the photoreceptor (developing process);
(4) the toner image is transferred on a receiving material optionally via an intermediate transfer medium (transfer process); and
(5) the toner image on the receiving material is fixed to produce a hard copy (fixing process).

As the developer, one-component developers constituted of only a non-magnetic or a magnetic toner, or two-component developers constituted of a toner and a carrier can be used.

Toners are typically prepared by the following kneading/pulverizing method:

(1) kneading a thermoplastic resin (i.e., a binder resin) and a pigment, optionally together with a release agent such as waxes and a charge controlling agent, upon application of heat thereto;
(2) cooling the kneaded mixture;
(3) pulverizing the mixture;
(4) classifying the pulverized mixture to prepare a mother toner;
(5) optionally mixing the mother toner with an external additive such as inorganic or organic particulate materials to improve the fluidity or cleanability of the resultant toner, resulting in preparation of a toner.

The toners prepared by such a kneading/pulverizing method have an irregular form. It is possible to slightly change the form of such toners by changing the raw materials and/or pulverizing conditions, however, it is impossible to freely control the form and structure of the surface of the resultant toners.

In addition, it is hard to prepare a toner having a particle diameter distribution narrower than ever because current classifiers has a limited classification ability. Namely, when it is tried to prepare such a toner, a problem occurs in that the manufacturing cost seriously increases. In addition, it is hard to prepare a toner having such a small average particle diameter as not greater than 6 $\mu$m in view of yield, productivity and manufacturing cost of the toner.

The toners having an irregular form have a drawback in that the toner particles have different charging properties, and thereby the toner particles have different developing abilities because particles of a one-component developer having an irregular form have different contact areas (i.e., different adhesion) with the developing roller used and toner particles included in a two-component developer have different contact areas (i.e., different adhesion) with the carrier included in the two-component developer.

In addition, toner particles having different particle diameters have different charge quantities, and thereby the toner particles have different developing abilities.

When such toner particles having different developing abilities are present in a developer, toner particles which have a high developing ability are selectively used for developing, i.e., toner particles having a low developing ability tend to remain in a developing device, resulting in change of the developing properties of the toner (i.e., developer).

Similarly, when a toner image is transferred onto a receiving material, the toner image includes toner particles having different transferring abilities, and thereby image defects such as toner scattering tend to be produced.

In addition, when a toner is prepared by internally adding a-release agent such as waxes, the release agent tends to be mainly present in surface portions of the toner particles, depending on the affinity of the release agent with the resin included in the toner particles. In particular, when a resin which has an elasticity because of including high molecular weight components and which is hard to pulverize is used in combination with a brittle wax such as polypropylene, the surface portions of the resultant toner particles tend to include the wax in an amount greater than that inside of the toner particles.

The toner in which a release agent is present in the surface portions at a high content has advantages such that the toner particles tend to be easily released from fixing devices and toner particles remaining on a photoreceptor can be easily removed. However, the toner has drawbacks in that the toner contaminates the developing rollers, photoreceptors and carriers used and thereby the reliability of the image forming apparatus deteriorates.

In attempting to solve the problems of the kneading/pulverization methods, suspension polymerization methods have been proposed. Since the suspension polymerization methods do not include the kneading and pulverization processes, the methods have advantages in that production energy can be saved, production time can be shortened and yield can be increased, resulting in decrease of manufacturing cost.

In addition, the toners prepared by such suspension polymerization methods have relatively narrow particle diameter distribution compared to the toners prepared by the kneading/pulverization methods. Further, it is possible to include a wax inside toner particles, resulting in improvement of the fluidity of the resultant toner.

Thus the suspension pulverization methods have various advantages. Therefore the pulverization methods attract attention now, and researches in binder resins and polymerization methods have been vigorously performed.

However, the suspension polymerization methods have drawbacks. For example, toner particles prepared by the suspension polymerization methods have almost a true spherical form because surface tension acts on particles in a polymerization process. Toners having a spherical form have good charge stability and transferability but have poor cleanability, i.e., toner particles remaining on the surface of an image bearing member can be hardly removed, and thereby problems such that the resultant images have background fouling and uneven image densities because the developing density cannot be controlled due to the remaining toner particles. Specifically, when toner particles remain on the surface of a photoreceptor, the surface potential is mistakenly measured, and thereby the next image is developed under improper developing conditions, resulting in formation of an image having an undesired image density.

With respect to the toner form of the toners prepared by such suspension polymerization methods, Japanese Laid-Open Patent Publication No. (hereinafter referred to as JOP) 11-149177 discloses that when a toner having a form coefficient SF-1 not greater than 110, it becomes hard to remove toner particles remaining on an image bearing member, resulting unsatisfactory cleaning. JOPs 08-44111 and 08-286416 have disclosed suspension polymerization methods. When a toner is prepared by such a suspension polymerization method, it is necessary to control the particle diameter of the suspended particles so as to fall in a proper range. Therefore, it is necessary to strongly agitate the dispersion at a high speed such that the toner constituents are finely dispersed in a dispersion medium. However, in general a release agent and a monomer which is to be polymerized to form a binder resin have different viscosity and have poor compatibility with each other. Therefore to finely disperse the toner constituents in the suspension process is very difficult. As a result, a number of toner particles not including a wax (i.e., a release agent) are included in the resultant toner, namely a wax is unevenly present in toner particles, and thereby the resultant toner has poor charge stability and cleanability.

JOP 05-34979 discloses a toner for use in an image forming method in which a toner image formed by a developer bearing member of a two component developing device having functions of developing, transferring and cleaning is transferred on a receiving material, wherein the toner has a concavo-convex surface. Toner particles having concave and convex on their surface necessarily have projections on their surface. When such toner particles are used in combination with a carrier to perform two-component developing, the projections are abraded, resulting in change of the form of the toner particles, and thereby the cleanability of the toner deteriorates.

In addition, when a toner is prepared by suspension polymerization, the toner tends to include residues such as monomers, e.g., styrene monomers and acrylic monomers, which are not preferable in view of environmental pollution. Further, the toner has good fluidity and a problem in that the toner adheres to the photoreceptor used can be avoided because a release agent such as waxes is included in the toner particles. However, since a release agent is included in the toner particles, the toner has poor fixing efficiency because fixing energy is needed more than in the case of using a toner which is prepared by the kneading/pulverization method and in which the release agent mainly located at the surface portions of the toner particles.

When the addition amount of a release agent is increased or the particle diameter of a release agent dispersed in toner particles is increased in attempting to improve the fixability, the transparency of the resultant toner deteriorates and thereby the color tones of color images formed by projecting color toner images formed on an OHP sheet deteriorate.

Methods for preparing a toner utilizing polymerization include not only the suspension polymerization methods mentioned above but also emulsion polymerization methods and solution-suspension polymerization methods, in which the form of the resultant toner can be relatively easily changed into a sub-spherical form, i.e., a form which is similar to true spherical form but is slightly deformed, such as orbital forms, and spherical forms having a rough surface.

When emulsion polymerization methods are used, it is difficult to perfectly remove monomers (e.g., styrene monomers) emulsifiers and dispersants. This is a large problem in view of environmental protection. In addition, toner particles prepared by an emulsion polymerization methods typically have a concavo-convex surface to prevent the cleaning problem mentioned above. In this case, an external additive (such as silica) added thereto has poor adhesion to the concave surface or the external additive adhered to the convex surface is transferred on the concave surface, resulting in decrease of the adhesion of the external additive to the toner particles, and thereby the external additive is released from the toner particles. Thus, problems in that the photoreceptor and fixing roller used are contaminated by the toner occur.

When solution-suspension methods are used, it becomes possible to use polyester resins typically having a good low temperature fixability. However, the methods have the following drawbacks:

(1) in order to prepare a toner for use in oil-less fixing methods or to widen the-releasing temperature range, the quantity of the high molecular weight (about not less than 100,000) components in the resultant polymer toner has to be controlled, which is very difficult; and (2) when a toner is prepared, a high molecular weight component is added in a process in which a resin and a colorant are dissolved or dispersed in a solvent, resulting in increase of the viscosity of the dispersion (or solution), and thereby it is difficult to stably produce a toner.

These drawbacks have not yet been remedied.

JOP 09-15903 discloses a toner which is prepared by a solution suspension method and which has a spherical form, wherein the surface of the toner particles has concave and convex in attempting to improve the cleanability of the toner. However, the concave and convex are formed irregularly, and thereby the toner has poor charge stability. In addition, the content of the high molecular weight components is not controlled, and therefore the qualities of the toner such as durability and releasability are not satisfactory.

JOP 11-149180 discloses a toner which is prepared by reacting a prepolymer having an isocyanate group with an amine in an aqueous liquid to perform an elongation reaction and a crosslinking reaction, resulting in formation of toner particles. Small toner particles can be made by this method but the form of the toner particles is hardly controlled because the way to control the spherical degree of the toner particles is not described therein.

Electrophotographic image forming methods typically include a developing process, a transfer process, a cleaning process and a fixing process. In addition, there are color image forming methods in which plural color toner images formed on a photoreceptor or plural photoreceptors are transferred on an intermediate transfer medium to form a (full) color image and the color image is then transferred on a receiving material. When polymerization toners (i.e., toners having a spherical form) are used in such color image forming methods, toner particles remaining on the intermediate transfer medium cannot be easily removed although the toners have good transferability. Therefore, the polymerization toners are needed to be improved.

Because of these reasons, a need exists for a toner which can produce high quality images even when the toner images are fixed at a low temperature by an oil-less fixing method while having good cleanability and which can be stably manufactured.

SUMMARY OF THE INVENTION

Accordingly, an object of the present invention is to provide a toner having the following advantages:

(1) capable of producing images having good fine line reproducibility and good half tone reproducibility;
(2) having good charge stability;
(3) capable of being used for an oil-less fixing method while having good charge stability and low temperature fixability;
(4) having a good combination of transferability and transparency (i.e., capable of projecting high quality color images when used for OHP sheets); and
(5) including low molecular weight components such as monomers in an amount less than ever (i.e., being environmentally friendly).

Another object of the present invention is to provide a method for manufacturing the toner mentioned above.

Yet another object of the present invention is to provide an image forming apparatus which can stably produce high quality images at low energy consumption without causing the cleaning problem.

Briefly these objects and other objects of the present invention as hereinafter will become more readily apparent can be attained by a toner composition including toner particles including mother toner particles including a binder resin, a colorant and a release agent; and a charge controlling agent, wherein the charge controlling agent is located on at least a surface of the mother toner particles and fixed thereon, and wherein the toner particles have a spherical degree of from 0.960 to 1.000 and a specific surface area of from 0.70 to 2.5 $m^2/g$.

The toner composition optionally includes an external additive which is present on at least a surface of the toner particles.

The toner composition and toner particles preferably have a volume average particle diameter of from 3.0 to 8.0 $\mu$m. In addition, the toner preferably satisfies the following relationship:

$$1.00 \leqq Dv/Dn \leqq 1.20,$$

wherein Dv represents the volume average particle diameter of the toner composition (or toner particles); and Dn represents the number average particle diameter of the toner composition (or toner particles).

The binder resin preferably includes a polyester resin in an amount greater than the amount of any of other resins included as the binder resin. The polyester resin preferably has a glass transition temperature of from 55 to 75° C. and an acid value of from 1 to 30 mgKOH/g.

In the present invention, the "mother toner particles" are defined as particles including at least a binder resin, a colorant and a release agent. The "toner particles" are defied as particles in which a charge controlling agent is fixed on the surface of the mother tone particles. The "toner composition" is defined as a composition which includes the toner particles and optionally an external additive which is present on at least a surface of the toner particles.

In another aspect of the present invention, a method for manufacturing toner particles is provided which includes:

reacting a prepolymer having an isocyanate group with an amine in an aqueous liquid including at least one of an inorganic dispersant and a particulate polymer to perform an elongation reaction and a crosslinking reaction of the prepolymer and to prepare a urea-modified polyester resin;

dissolving at, least the urea-modified polyester resin in an organic solvent to prepare a binder solution;

dispersing at least the solution, a colorant and a release agent in an aqueous liquid to prepare a dispersion;

removing at least the organic solvent from the dispersion to prepare mother toner particles; and fixing a charge controlling agent on a surface of the mother toner particles to prepare toner particles, wherein the toner particles have a spherical degree of from 0.960 to 1.000 and a specific surface area of from 0.70 to 2.5 $m^2/g$.

The method may include a step of mixing the toner particles with an external additive to prepare a toner composition. In the dissolving step, the urea-modified polyester resin is preferably used in combination with another binder resin such as modified polyester resins.

Alternatively, at least a prepolymer having an isocyanate group, an amine, an organic solvent, a release agent and a colorant are mixed and dispersed in an aqueous liquid to react the prepolymer with the amine in the aqueous liquid and to prepare a dispersion.

In yet another aspect of the present invention, an image forming apparatus is provided which includes a photoreceptor, a charger configured to charge the photoreceptor, a light irradiator configured to irradiate the photoreceptor with imagewise light to form an electrostatic latent image on the photoreceptor, an image developer configured to develop the electrostatic latent image with a developer including the toner composition mentioned above to form a toner image on the photoreceptor, a transfer device configured to transfer the toner image to a receiving material optionally via an intermediate transfer medium, and a fixer configured to fix the toner image on the receiving material. The image forming apparatus optionally has a cleaner configured to remove the toner remaining on the photoreceptor after the image transfer process.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
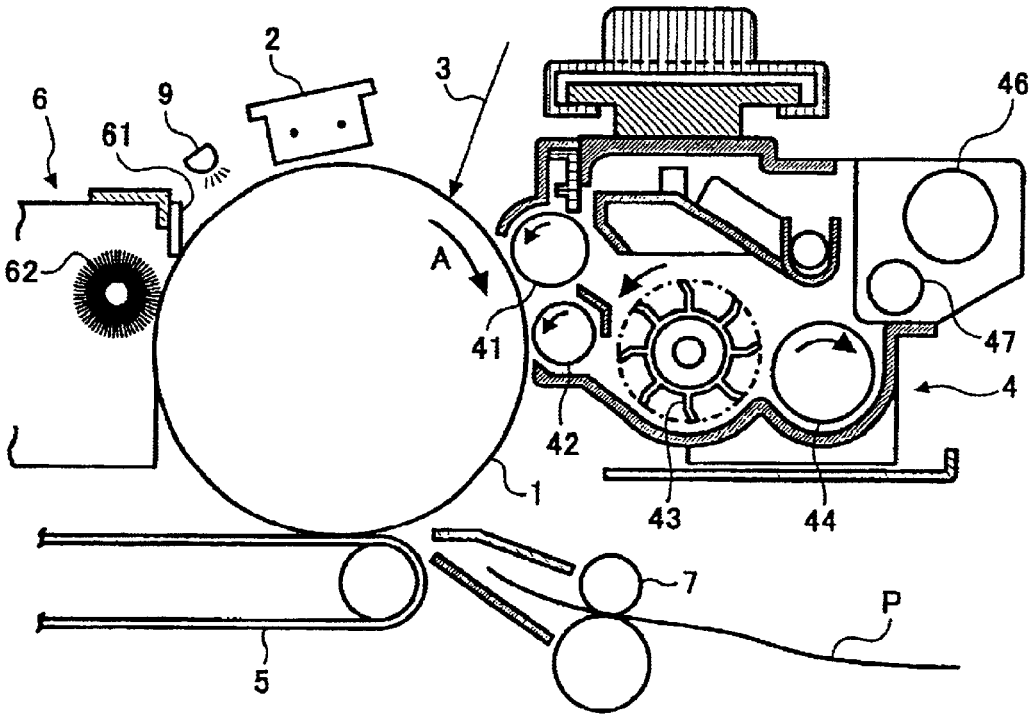
FIG. 1 is a schematic view illustrating a main portion of an embodiment of the image forming apparatus of the present invention.

The toner composition of the present invention includes toner particles, which includes mother toner particles including a resin, a colorant and a release agent and a charge controlling agent, wherein the charge controlling agent is at least located on a surface of the mother toner particles and fixed thereon, and wherein the toner particles have a spherical degree of from 0.960 to 1.000. In addition, the specific surface area of the toner particles is from 0.70 to 2.5 $m^2/g$. The fixation of the charge controlling agent means that particles of the charge controlling agent fixedly adhere on the surface of the toner particles while the particles of the charge controlling agent are further micronized or the charge controlling agent adheres on the surface of the mother toner particles while the charge controlling agent forms a film on the mother toner particles such that the film does not easily release from the surface of the toner particles.

This is confirmed by observing the surface of toner particles with an electron microscope. When observed by an electron microscope, particles of a charge controlling agent have a particle diameter on the order of sub-microns before being added to toner particles. When this charge controlling agent is added to toner particles and mixed upon application of high agitating energy thereto, the charge controlling agent is micronized or filmed such that the particles of the charge controlling agent cannot be observed with an electron microscope. Whether or not the toner particles and charge controlling agent have such a constitution can be determined by measuring the specific surface area of the toner particles.

Namely, when the charge controlling agent maintains a granular form, the adhesion of the charge controlling agent to the mother toner particles is weak and therefore the charge controlling agent is not fixed. Conventionally, it is possible to prepare a spherical toner having a sharp particle diameter distribution. However, the charge properties of such a toner cannot be controlled, and in particular the charge properties are not stable when environmental conditions change. Particularly, when a polyester resin is used as the binder resin, the resultant toner has poor charge stability when environmental conditions change.

In contrast, since a charge controlling agent is fixed on the surface of a spherical toner in the present invention, the resultant toner can maintain good charge stability even when environmental conditions change.

In the present invention, the ratio (St/Sp) of the surface area (St) of the toner particles on which a charge controlling agent is fixed to the surface area (Sp) of the mother toner particles (i.e., the surface area of the toner particles before the charge controlling agent is added) is preferably not greater than 110.0%.

In order to produce high quality images (high resolution images), the toner composition of the present invention preferably has a volume average particle diameter of from 3.0 to 8.0 $\mu$m, and in addition, the toner preferably satisfies the following relationship:

$$1.00 \leqq Dv/Dn \leqq 1.20,$$

wherein Dv represents the volume average particle diameter of the toner composition; and Dn represents the number average particle diameter of the toner composition.

More preferably, the volume average particle diameter is from 3.0 to 6.0 $\mu$m and the ratio Dv/Dn is from 1.00 to 1.15. In addition, it is preferable that particles having a particle diameter not greater than 3 $\mu$m are included in the toner in an amount of from 1 to 10%, and particles having a particle diameter not less than 8 $\mu$m are included therein in an amount of from 1 to 10%.

In order to produce the toner composition mentioned above, a polyester resin is included in the toner as a main binder (i.e., included in a largest amount among the binder resins included therein). The polyester resin preferably has a molecular weight distribution in which a main peak is observed at a molecular weight of from 1,000 to 30,000 when the molecular weight is measured by a GPC method with respect to the tetrahydrofuran-soluble components of the resin. In addition, the polyester resin preferably includes components having a molecular weight not less than 30000 in an amount of from 1 to 10% by weight. Further, the Mw/Mn ratio is preferably not greater than 5. Since the toner composition of the present invention has such physical properties, the toner can produce high quality images without applying an oil to the fixing roller used.

In order to prepare the toner mentioned above which includes a polyester resin, the following method is preferably used. At first, a prepolymer having an isocyanate group is dispersed together with a colorant and a release agent in an aqueous liquid including an inorganic dispersant or a particulate polymer. Then the prepolymer is reacted with an amine to perform an elongation reaction and a crosslinking reaction. Thus an emulsion is prepared. Then the solvent is removed from the emulsion to prepare mother toner particles. The mother toner particles are mixed with a charge controlling agent to fix the charge controlling agent thereon, resulting in formation of toner particles. The toner particles are optionally mixed with an external additive to prepare the toner composition.

Alternatively, at first the prepolymer may be reacted with an amine to prepare a binder resin. Then the binder resin, which is dissolved in an organic solvent, a release agent and a colorant are dispersed in an aqueous liquid. Then at least the solvent is removed from the dispersion to form mother toner particles.

The toner of the present invention is used for electrophotography, electrostatic recording and electroprinting, i.e., for developing electrostatic latent images. Therefore, the toner has to have well-balanced properties.

At first, in order to impart basic toner properties to the toner, the binder resin preferably includes a polyester resin as a main binder. The polyester resin preferably has a molecular weight distribution in which a main peak is observed at a molecular weight of from 1,000 to 30,000. In addition, the polyester resin preferably includes components having a molecular weight not less than 30,000 in an amount of from 1 to 10%. Further, the polyester resin preferably has a Mw/Mn ratio not greater than 5.

Furthermore, the polyester resin preferably include components having a molecular weight not greater than 1, 000 in an amount of from 0.1 to 5% to prevent deterioration of the high temperature preservability of the toner. When such low molecular weight components are included in a large amount, the high temperature preservability deteriorates, and in addition the charge properties deteriorate when the toner is preserved for a long period of time, resulting in occurrence of toner scattering.

In the toner composition of the present invention, the amount of a release agent (e.g., a wax) present in surface portions of the toner particles is relatively small and in addition the wax is finely dispersed in the toner particles. Therefore, the toner has good transparency and can be preferably used for color toners. When such color toners are used, small-sized and low-cost color copiers and printers can be realized because it is not needed to apply an oil to the fixing roller.

When a toner including a release agent is prepared by a conventional kneading/pulverizing method, the release agent is unevenly distributed in the toner particles. Namely, the release agent tends to be present in the surface portion of the resultant toner particles. However, when a toner is prepared by the method of the present invention, a release agent can be finely and evenly dispersed in the toner particles. In addition, when a toner including a release agent is prepared by suspension polymerization method, the release agent is included in the polymerized resin and thereby the releasing effect deteriorates. Further, when a toner is prepared by a conventional polymerization method, polyester resins cannot be used as the binder resin.

However, as mentioned above, by using the toner manufacturing method of the present invention, polyester resins can be used as the binder resin. Therefore a toner which has good powder properties and which has good transfer efficiency can be provided.

As mentioned above, it is possible to finely disperse a wax in toner particles compared to toners prepared by pulverization methods. In addition, small size toners having a particle diameter of form 4 to 6 $\mu$m, which cannot be prepared by pulverization methods in view of productivity and manufacturing cost, can be easily prepared by the method of the present invention.

In the toner of the present invention, a release agent is finely dispersed in toner particles and therefore high quality color images can be produced. Particularly, color images having good transparency and good color reproducibility can be formed on an OHP (overhead projection) sheet.

In addition, the toner of the present invention is preferably used for image forming apparatus in which toner images formed on an image bearing member (or plural image bearing members) are transferred on an intermediate transfer medium one by one and the toner images on the intermediate transfer medium is second transferred on a receiving material at once. The toner can produce images having good image qualities without causing mis-transferring and toner scattering.

Then the physical properties of the toner composition of the present invention will be explained.

Particle Diameter Distribution

The toner composition of the present invention preferably has a volume average particle diameter of from 3.0 to 8.0 $\mu$m. In addition, the ratio (Dv/Dn) of the volume average particle diameter (Dv) of the toner composition to the number average particle diameter (Dn) is preferably from 1.00 to 1.20. Further, it is more preferable that the toner composition includes particles having a particle diameter not greater than 3 $\mu$m in an amount of from 1 to 10% by number, and the volume average particle diameter is from 3.0 to 6.0 $\mu$m and the ratio (Dv/Dn) is from 1.00 to 1.15. The toner composition having such physical properties has good high-temperature preservability, good low temperature fixability and good hot offset resistance. In addition, when the toner composition is used for color image forming apparatus such as color copiers, the resultant color images have high gloss. Further, when the toner composition is used for a two-component developer, the particle diameter of the toner in the two-component developer hardly changes even when the developer is used for a long period of time while the toner is replenished to control the toner concentration so as to be constant. In addition, even when the developer is agitated for a long period of time in a developing device, the developer can maintain good developing properties.

The toner composition of the present invention can be used as a one-component developer. Even when the toner composition is used as a one-component developer, the particle diameter of the toner (developer) hardly changes and in addition the developer hardly causes problems such that a toner film is formed on the developing roller used and the toner adheres to the developing blade which regulates the toner to form a toner layer on the developing roller. Namely, even when the toner is used for a long period of time while being agitated in a developing device, images having good image qualities can be stably produced.

In general, the smaller the particle diameter of a toner, the better the image qualities of the images produced by the toner. However, when the particle diameter is small, adversely affects such that the transferability and cleanability of the toner deteriorate are exerted. When the toner has a volume average particle diameter less than the lower limit (i.e., 3.0 $\mu$m), problems tend to occur such that the toner adheres to the surface of the carrier used, resulting in deterioration of the charging ability of the carrier; a film of the toner (one-component developer) is formed on the developing roller used; and the toner (one-component developer) adheres to the toner blade which is used for regulating the toner.

In addition, these problems also depend on the content of the fine particles of the toner. Specifically, when the toner includes particles having a particle diameter not greater than 3.0 $\mu$m in an amount greater than 10% by number, problems which occur are that the toner adheres to the carrier used; and the charging ability of the toner cannot be maintained at a high level.

In contrast, when the toner has an average particle diameter much greater than 8.0 $\mu$m, high definition images cannot be produced. In addition, when the toner is used for a long period of time while the toner is replenished to the developer, the average particle diameter of the toner included in the developer widely changes, resulting in deterioration of the image qualities. The same is true for the case in which the ratio (DV/Dn) is greater than 1.20, The average particle diameter and particle diameter distribution of toner and toner particles can be measured, for example, by an instrument such as COULTER COUNTER TA-II or COULTER MULTICIZER II manufactured by Coulter Electronics, Inc. In the present invention, the COULTER COUNTER TA-II is used together with an interface which can output particle diameter distributions on number basis and volume basis and which is manufactured by Nikkaki Bios Co., Ltd. and a personal computer PC9801 manufactured by NEC Corp.

The procedure is as follows:

(1) a surfactant serving as a dispersant, preferably 0.1 to 5 ml of a 1% aqueous solution of an alkylbenzenesulfonic acid salt, is added to an electrolyte such as 1% aqueous solution of first class NaCl or ISOTON-II manufactured by Coulter Scientific Japan;
(2) 2 to 20 mg of a sample to be measured is added into the mixture;
(3) the mixture is subjected to an ultrasonic dispersion treatment for about 1 to 3 minutes; and
(4) the volume average particle diameter distribution and number average particle diameter distribution of the sample are measured using the instrument and an aperture of 100 $\mu$m.

In the present invention, the following 13 channels are used:

(1) not less than 2.00 μm and less than 2.52 μm;
(2) not less than 2.52 μm and less than 3.17 μm;
(3) not less than 3.17 μm and less than 4.00 μm;
(4) not less than 4.00 μm and less than 5.04 μm;
(5) not less than 5.04 μm and less than 6.35 μm;
(6) not less than 6.35 μm and less than 8.00 μm;
(7) not less than 8.00 μm and less than 10.08 μm;
(8) not less than 10.08 μm and less than 12.70 μm;
(9) not less than 12.70 μm and less than 16.00 μm;
(10) not less than 16.00 μm and less than 20.20 μm;
(11) not less than 20.20 μm and less than 25.40 μm;
(12) not less than 25.40 μm and less than 32.00 μm; and
(13) not less than 32.00 μm and less than 40.30 μm.

Namely, particles having a particle diameter of from 2.00 μm to 40.30 μm are targeted.

The ratio (Dv/Dn) is determined by dividing the thus determined volume average particle diameter (Dv) by the determined number average particle diameter (Dn).

Specific Surface Area

The specific surface area of a spherical toner is measured by a BET method, i.e., the multipoint method of the nitrogen absorption method. The unit of the specific surface area is $m^2/g$. Specifically, in the present invention the specific surface area is measured by a NOVA 1200 multipoint method using a high speed specific surface area/fine hole distribution measuring instrument manufactured by YUASA TONICS.

Measuring conditions are as follows:

(1) absorption gas: nitrogen gas (purity of 99.995 or more)
(2) cooling medium: liquid nitrogen
(3) cell used: 9 mm pellet short (large)
(4) pretreatment condition: the sample is allowed to settle at a temperature of 30° C. for 12 hours while performing vacuum pumping.
(5) Measuring point: three points in which the relative pressure (P/PO) is from 0.1 to 0.3.

In the present invention, a charge controlling agent is fixed on the surface of mother toner particles to impart good charge stability to the resultant toner particles. The specific surface area of the toner particles on which a charge controlling agent is fixed is measured.

One of the features of the present invention is that the toner composition has a specific surface area of from 0.70 to 2.5 $m^2/g$.

The specific surface area is an alternative characteristic of the form of a toner. In addition, the form of the surface of the toner and the surface condition thereof can be determined by measuring the specific surface area of the toner. Specifically, when the specific surface area is greater than 2.5 $m^2/g$, the surface of the toner composition is not smooth, and thereby the transferability and charge stability of the toner composition deteriorate. When the specific surface area is less than 0.70 $m^2/g$, there is no large problem but the average particle diameter of the resultant toner composition tends to fall out of the preferable range.

The toner composition of the present invention has the above-mentioned properties and includes spherical particles having a smooth surface. Therefore the toner composition has a specific surface area smaller than those of sub-spherical toners and pulverization toners. When a charge controlling agent is adhered on the surface of the mother toner particles, the specific surface area of the toner composition increases. When an energy is applied to the mixture of the charge controlling agent and the toner particles, the charge controlling agent is micronized and fixed on the surface of the toner particles. Thus the specific surface area of the toner composition decreases. Namely, the specific surface area of the toner particles falls within 110% of the specific surface area of the mother toner particles. As the charge controlling agent is embedded into the mother toner particles, the percentage (i.e., the ratio St/Sp) decreases. When the percentage is 110% or less, the resultant toner composition has good charging ability (i.e., the charge controlling agent exerts good effects). The thus prepared toner composition can maintain its charge stability for a long period of time. In addition, even when the toner composition is mixed with a carrier to perform two-component developing, the charge controlling agent fixed on the surface of the toner particles hardly releases from the toner particles, and thereby the charge stability of the toner can be maintained. Therefore images having good image qualities can be produced.

Spherical Degree

The spherical degree of toner composition can be determined by a flow-type particle image analyzer, FPIA-2100 manufactured by SYSMEX CORPORATION.

The toner composition of the present invention preferably has a spherical degree of from 0.960 to 1.000, i.e., preferably has a specific form and a specific form distribution (specifically, the toner composition has forms near the true spherical form but different from the sub-spherical form mentioned above). When the toner composition has an average spherical degree less than 0.960, i.e., the toner composition has a form largely different from a spherical form, high quality images cannot be produced (for example, transferablity deteriorates and the resultant images have background fogging).

When a toner composition having an irregular form is used, the toner contacts image bearing members such as photoreceptors at many points. In addition, since charges are mainly formed on projected portions of the toner composition, the toner composition having an irregular form has higher van der Waals' force and viscosity force (i.e., energy generated at a boundary between particles) than toners having a spherical force. Therefore, when a toner having an irregular form (i.e., a toner including spherical toner particles and non-spherical toner particles) is used in an image transfer process using an electrostatic force, the spherical toner particles are selectively transferred to a receiving material, resulting in formation of omissions in character images and line images.

Since the toner particles remaining on the image bearing members should be removed to be ready for the next image forming operation, a cleaning device is needed and in addition the toner yield deteriorates (i.e., a ratio of the weight of the toner used for image forming to the total weight of the toner consumed decreases). The spherical degree of toners prepared by pulverization methods, which is measured by the method mentioned below, is typically from 0.910 to 0.920.

In the present invention, the spherical degree of a toner is measured as follows:

(1) a suspension including particles to be measured is passed through a detection area formed on a plate in the measuring instrument; and
(2) the particles are optically detected by a CCD camera and then the shapes thereof are analyzed.

The spherical degree of a particle is determined by the following equation:

$$\text{Spherical degree} = Cs/Cp$$

wherein Cp represents the length of the circumference of the projected image of a particle and Cs represents the length of the circumference of a circle having the same area as that of the projected image of the particle.

When the average spherical degree is not less than 0.960, the resultant toner can stably produce images having a proper image density and high resolution. It is more preferable for the toner of the present invention to have an average spherical degree of from 0.980 to 1.000.

Specifically, the method of determining the average spherical degree of a toner is as follows:

(1) 0.1 g to 0.5 g of a sample to be measured is mixed with 100 to 150 ml of water from which solid impurities have been removed and which includes 0.1 ml to 0.5 ml of a dispersant (i.e., a surfactant) such as an alkylbenzene sulfonic acid salt;

(2) the mixture is dispersed using an ultrasonic dispersing machine for about 1 to 3 minutes to prepare a suspension including particles of 3,000 to 10,000 per 1 micro-liter of the suspension; and (3) the average spherical degree of the sample in the suspension is determined by the measuring instrument mentioned above.

In attempting to improve the hot offset resistance of toners, various studies concerning molecular weight of binder resins have been made. In attempting to obtain a good combination of low temperature fixability and hot offset resistance which are trade-off properties, for example, the following methods have been proposed:

(1) a binder resin having a wide molecular weight distribution is used; and (2) a combination of a first polymer component having a high molecular weight of from hundreds thousand to a few million and a second polymer component having a low molecular weight of from a few thousand to tens thousand is used as a binder resin to exert their own effects (in this case, it is preferable that the first polymer component has a crosslinked structure or achieves a gelled state to improve the hot offset resistance).

However, toners including the binder resin as mentioned above in (2) cannot be used for full color toners because the resultant color toner images cannot satisfy the gloss and transparency required for full color images.

When the toner of the present invention is prepared, a polyester is elongated (i.e., the molecular weight of a polyester is increased) using a urea bonding, and therefore a proper amount of a high molecular weight component can be included in the toner. Thereby, the hot offset resistance can be improved while the properties such as transparency and gloss are maintained. Specifically by including such a high molecular weight component (molecular weight not less than 30,000) by 1 to 10%, the hot offset resistance can be improved.

In the present invention, toner constituents are granulated in an aqueous liquid while the binder resin is addition-polymerized. The molecular weight distribution of such a binder resin is measured as follows:

(1) a toner of, about 1 gram is precisely weighed;

(2) the toner is mixed with 10 to 20 g of tetrahydrofuran to prepare a tetrahydrofuran solution of the binder resin having a concentration of from 5 to 10%;

(3) tetrahydrofuran is flown through a column, which is heated to 40° C. in a heat chamber, at a flow rate of 1 ml/min and 20 $\mu$l of the sample solution is injected thereto to determine the molecular weight distribution of the binder resin using a working curve which shows the relationship between a molecular weight and a retention time and which is previously prepared using polystyrenes having a single molecular distribution of from $2.7\times10^2$ to $6.2\times10^6$.

As the detector, a refractive index (RI) detector is used. As the column, TSKgel, C1000H, G2000H, G2500H, G3000H, G4000H, G5000H, G6000H, G7000H and GMH, which are manufactured by TOSO CORPORATION, are used in combination.

The binder resin for use in the toner composition of the present invention preferably has a main peak of the molecular weight at 1,000 to 30,000, more preferably at 1,500 to 10,000, and even more preferably at 2,000 to 8,000.

When the amount of the components having a molecular weight less than 1,000 increases, the high temperature preservability of the resultant toner deteriorates. In contrast, when the amount of the components having a molecular weight greater than 30,000 increases, the low-temperature fixability of the resultant toner tends to deteriorate. Therefore it is preferable to control the amount of the components having a molecular weight greater than 30,000 in a preferable range of from 1% to 10% and more preferably from 3 to 6%, which changes depending on the toner constituents. When the amount of the components having a molecular weight greater than 30,000 is less than 1%, the hot offset resistance is not satisfactory. In contrast, when the amount is greater than 10%, the gloss and transparency of the resultant toner deteriorates.

The number average molecular weight (Mn) of the binder resin of the toner composition of the present invention is preferably from 2,000 to 15,000, and the ratio (Mw/Mn) is preferably not greater than 5, wherein Mw represents the weight average molecular weight. When the ratio is greater than 5, the resultant toner does not sharply melt in a fixing process, and in addition the resultant images have low gloss.

In addition, the polyester resin for use in the toner composition of the present invention preferably includes a tetrahydrofuran-insoluble component (hereinafter referred to as a THF-insoluble component) in an amount of from 1 to 10% by weight, to improve the hot offset resistance of the resultant toner. In addition, the release temperature range of the resultant toner in which toner images can be easily released from a fixing roller can be widened. When the content of the THF-insoluble component is too high, the resultant toner produces images having low gloss and transparency.

In the present invention, the content of the THF-insoluble component is measured as follows:

Method of Measuring the Content of THF-Insoluble Components (1) a resin (or a toner) of about 1.0 gram is precisely weighed (the weight is A);

(2) the resin is mixed with tetrahydrofuran of about 50 g and the mixture is allowed to settle for 24 hours at 20° C.;

(3) the mixture is subjected to a centrifugal treatment followed by a filtration treatment using a filter paper of JIS P3801 5C;

(4) the filtered liquid (i.e., the filtrate) is dried in a vacuum to evaporate tetrahydrofuran; and (5) the weight (B) of the residue of the filtered liquid is determined.

The content of THF-insoluble component is determined by the following equation:

$$\text{Content of THF-insoluble component } (\%)=\{(A-B)/A\}\times100$$

When the content of a THF-insoluble component in a toner is determined, the following equation is used:

$$\text{Content of THF-insoluble component } (\%)=\{(A-B-W2)/(A-W1-W2)\}\times100,$$

wherein W1 represents the weight of THF-insoluble components included in other toner constituents than the binder resin and W2 represents the weight of THF-soluble components included in the other toner constituents than the binder resin.

In this case, the weights W1 and W2 are preliminarily determined by a known method such as thermogravimetric (TG) analysis.

In the present invention, the toner particles are prepared, for example, by the following method:

(1) toner constituents including at least a resin and a colorant is dissolved or dispersed in an organic solvent;
(2) the solution (or dispersion) is dispersed in an aqueous medium including an inorganic dispersant or a particulate polymer;
(3) the solution (or dispersion) in the aqueous medium is addition-polymerized to prepare an emulsion; and
(4) the solvent of the emulsion is evaporated to prepare mother toner particles.

Alternatively, the toner particles of the toner composition of the present invention is prepared by the following method:

(1) a prepolymer having an isocyanate group is dispersed in an aqueous medium;
(2) the dispersed prepolymer is reacted with an amine to perform an elongation reaction and a crosslinking reaction to prepare an emulsion; and
(3) the solvent of the emulsion is evaporated to prepare toner particles.

As the binder resin, reaction products of a polyester prepolymer (A) having an isocyanate group with an amine (B) can be used. As the polyester prepolymer (A) having an isocyanate group, for example, compounds prepared by reacting a polycondensation product of a polyol (1) and a polycarboxylic acid (2) which has a group having an active hydrogen with a polyisocyanate (3) can be used. Suitable groups having an active hydrogen include a hydroxyl group (an alcoholic hydroxyl group and a phenolic hydroxyl group), an amino group, a carboxyl group, a mercapto group, etc. Among these groups, alcoholic hydroxyl groups are preferable.

Suitable polyols (1) include diols (1-1) and polyols (1-2) having three or more hydroxyl groups. It is preferable to use diols (1-1) alone or mixtures in which a small amount of a polyol (1-2) is added to a diol (1-1).

Specific examples of the diols (1-1) include alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the alicyclic diols mentioned above with an alkylene oxide (e.g., ethylene oxide, propylene oxide and butylene oxide); adducts of the bisphenols mentioned above with an alkylene oxide (e.g., ethylene oxide, propylene oxide and butylene oxide); etc.

Among these compounds, alkylene glycols having from-2 to 12 carbon atoms and adducts of bisphenols with an alkylene oxide are preferable. More preferably, adducts of bisphenols with an alkylene oxide, or mixtures of an adduct of bisphenols with an alkylene oxide and an alkylene glycol having from 2 to 12 carbon atoms are used.

Specific examples of the polyols (1-2) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide; etc.

Suitable polycarboxylic acids (2) include dicarboxylic acids (2-1) and polycarboxylic acids (2-2) having three or more carboxyl groups. It is preferable to use dicarboxylic acids (2-1) alone or mixtures in which a small amount of a polycarboxylic acid (2-2) is added to a dicarboxylic acid (2-1).

Specific examples of the dicarboxylic acids (2-1) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (2-2) having three or more hydroxyl groups include aromatic polycarboxylic acids having from 9 to 20 carbon atoms (e.g., trimellitic acid and pyromellitic acid).

As the polycarboxylic acid (2), anhydrides or lower alkyl esters (e.g., methyl esters, ethyl esters or isopropyl esters) of the polycarboxylic acids mentioned above can be used for the reaction with a polyol (1).

Suitable mixing ratio (i.e., an equivalence ratio [OH]/[COOH]) of a polyol (1) to a polycarboxylic acid (2) is from 2/1 to 1/1, preferably from 1.5/1 to 1/1 and more preferably from 1.3/1 to 1.02/1.

Specific examples of the polyisocyanates (3) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic didicosycantes (e.g., tolylene diisocyanate and diphenylmethane diisocyanate); aromatic aliphatic diisocyanates (e.g., $\alpha$, $\alpha$, $\alpha'$, $\alpha'$-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., [NCO]/[OH]) of a polyisocyanate (3) a polyester is from 5/1 to 1/1, preferably from 4/1 to 1.2/1 and more preferably from 2.5/1 to 1.5/1. When the [NCO]/[OH] ratio is too large, the low temperature fixability of the toner deteriorates. In contrast, when the ratio is too small, the content of the urea group in the modified polyesters decreases and thereby the hot-offset resistance of the toner deteriorates. The content of the constitutional component of a polyisocyanate (3) in the polyester prepolymer (A) having a polyisocyanate group at its end portion is from 0.5 to 40% by weight, preferably from 1 to 30% by weight and more preferably from 2 to 20% by weight. When the content is too low, the hot offset resistance of the toner deteriorates and in addition the heat resistance and low temperature fixability of the toner also deteriorate. In contrast, when the content is too high, the low temperature fixability of the toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is too small (less than 1 per 1 molecule), the molecular weight of the resultant urea-modified polyester decreases and thereby the hot offset resistance deteriorates.

Specific examples of the amines (B) include diamines (B1) polyamines (B2) having three or more amino groups, amino alcohols (B3), amino mercaptans (B4), amino acids (B5) and blocked amines (B6) in which the amines (B1–B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids include amino propionic acid and amino caproic acid. Specific examples of the blocked amines (B6) include ketimine compounds which are prepared by reacting one of the amines B1–B5 mentioned above with a ketone such as acetone, methyl ethyl ketone and methyl isobutyl ketone; oxazoline compounds, etc. Among these compounds, diamines (B1) and mixtures in which a diamine is mixed with a small amount of a polyamine (B2) are preferable.

The molecular weight of the urea-modified polyesters can be controlled using an elongation anticatalyst, if desired. Specific examples of the elongation anticatalyst include monoamines (e.g., diethyle amine, dibutyl amine, butyl amine and lauryl amine), and blocked amines (i.e., ketimine compounds) prepared by blocking the monoamines mentioned above.

The mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is too low or too high, the molecular weight of the resultant urea-modified polyester decreases, resulting in deterioration of the hot offset resistance of the resultant toner.

The urea-modified polyesters may include an urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the content of the urea bonding is too low, the hot offset resistance of the resultant toner deteriorates.

The urea-modified polyesters (i) can be prepared, for example, by a method such as one-shot methods or prepolymer methods. The weight average molecular weight of the urea-modified polyesters (i) is not less than 10,000, preferably from 20,000 to 10,000,000 and more preferably from 30,000 to 1,000,000. At this point, the urea-modified polyesters (i) are hardly solved in tetrahydrofuran as the molecular weight thereof increases. When the weight average molecular weight is too low, the hot offset resistance of the resultant toner deteriorates. The number average molecular weight of the urea-modified polyesters is not particularly limited (i.e., the weight average molecular weight should be primarily controlled so as to be in the range mentioned above) when a polyester resin (ii) which is not modified is used in combination. Namely, controlling of the weight average molecular weight of the urea-modified polyester resins has priority over controlling of the number average molecular weight thereof. However, when a urea-modified polyester is used alone, the number average molecular weight is from 2,000 to 15,000, preferably from 2,000 to 10,000 and more preferably from 2,000 to 8,000. When the number average molecular weight is too high, the low temperature fixability of the resultant toner deteriorates, and in addition the gloss of full color images decreases.

In the toner composition of the present invention, the urea-modified polyester resins (i) can be used alone or in combination with unmodified polyester resins (ii) as the binder resin of the toner composition. By using a combination of a urea-modified polyester resin (i) with an unmodified polyester resin (ii), the low temperature fixability of the toner can be improved and in addition the toner can produce color images having high gloss.

Suitable unmodified polyester resins (ii) include polycondensation products of a polyol (1) with a polycarboxylic acid (2). Specific examples of the polyol (1) and polycarboxylic acid (2) are mentioned above for use in the polyester resins (1). In addition, specific examples of the suitable polyol (1) and polycarboxylic acid (2) are also mentioned above.

In addition, as the unmodified polyester resins, polyester resins modified by a bonding (such as urethane bonding) other than a urea bonding, can also be used as well as the unmodified polyester resins mentioned above.

When a mixture of a modified polyester resin (i) with a unmodified polyester resin (ii) is used as the binder resin, it is preferable that the modified polyester resin (i) at least partially mixes with the unmodified polyester resin (ii) to improve the low temperature fixability and hot offset resistance of the toner. Namely, it is preferable that the modified polyester resin (i) has a structure similar to that of the unmodified polyester resin (ii). The mixing ratio (i/ii) of a modified polyester resin (i) to an unmodified polyester resin (ii) is from 5/95 to 80/20, preferably from 5/95 to 30/70, more preferably from 5/95 to 25/75, and even more preferably from 7/93 to 20/80. When the addition amount of the modified polyester resin (i) is too small, the hot offset resistance deteriorates and in addition, it is impossible to achieve a good combination of high temperature preservability and low temperature fixability.

It is preferable for the unmodified polyester resins (ii) to have a hydroxyl value not less than 5, and an acid value of from 1 to 30 mgKOH/g, and more preferably from 5 to 20 mgKOH/g.

In the present invention, the binder resin preferably has a glass transition temperature (Tg) of from 55 to 75° C., and preferably from 55 to 65° C. When the glass transition temperature is too low, the high temperature presrevability of the toner deteriorates. In contrast, when the glass transition temperature is too high, the low temperature fixability deteriorates. When a urea-modified polyester resin is used in combination with an unmodified polyester resin as the binder resin, the resultant toner has better high temperature preservability than conventional toners including a polyester resin as a binder resin even if the urea-modified polyester resin has a relatively low glass transition temperature.

Release Agent

The toner composition of the present invention includes a release agent. Suitable release agents include waxes having a melting point of from 50 to 120° C. When such a wax is included in the toner, the wax is dispersed in the binder resin and serves as a release agent at a location between a fixing roller and the toner particles. Thereby hot offset resistance can be improved without applying an oil to the fixing roller used.

In the present invention, the melting point of the release agents is measured by a differential scanning calorimeter (DSC). The maximum absorption peak is defined as the melting point.

Specific examples of the release agent include natural waxes such as vegetable waxes, e.g., carnauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes. In addition, fatty acid amides such as 1,2-hydroxylstearic acid amide, stearic acid amide and phthalic anhydride imide; and low molecular weight crystalline polymers such as acrylic homopolymer and copolymers having a long alkyl group in their side chain, e.g., poly-n-stearyl methacrylate, poly-n-laurylmethacrylate and n-stearyl acrylate-ethyl methacrylate copolymers, can also be used.

Colorant

Suitable colorants for use in the toner of the present invention include known dyes and pigments. Specific examples of the colorants include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCC), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight, based on total weight of the toner.

Master batch pigments, which are prepared by combining a colorant with a resin, can be used as the colorant of the toner composition of the present invention. Specific examples of the resin for use in the master batch pigments or for use in combination with master batch pigments include the modified and unmodified polyester resins mentioned above; styrene polymers and substituted styrene polymers such as polystyrene, poly-p-chlorostyrene and polyvinyltoluene; styrene copolymers such as styrene-p-chlorostyrene copolymers, -styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The master batch for use in the toner composition of the present invention is typically prepared by mixing and kneading a resin and a colorant upon application of high shear stress thereto. In this case, an organic solvent can be used to heighten the interaction of the colorant with the resin. In addition, flushing methods in which an aqueous paste including a colorant is mixed with a resin solution of an organic solvent to transfer the colorant to the resin solution and then the aqueous liquid and organic solvent are separated and removed can be preferably used because the resultant wet cake of the colorant can be used as it is. Of course, a dry powder which is prepared by drying the wet cake can also be used as a colorant. In this case, three roll mill can be preferably used for kneading the mixture upon application of high shear stress.

Charge Controlling Agent

In the present invention, a charge controlling agent is fixed on the surface of the toner particles, for example, by the following method. Toner particles including at least a resin and a colorant are mixed with particles of a release agent in a container using a rotor. In this case, it is preferable that the container does not have a portion projected from the inside surface of the container, and the peripheral velocity of the rotor is preferably from 40 to 150 m/sec.

Specific examples of the charge controlling agent include known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc.

Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid) E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large charge quantity, and thereby the electrostatic force of a developing roller attracting the toner increases, resulting in deterioration of the fluidity of the toner and decrease of the image density of toner images.

These charge controlling agent and release agent can be kneaded together with a master batch pigment and resin. In addition, the charge controlling agent and release agent can be added when such toner constituents are dissolved or dispersed in an organic solvent.

External Additive

The thus prepared toner particles including a charge controlling agent on the surface thereof may be mixed with an external additive to assist in improving the fluidity, developing property and charging ability of the toner particles. Suitable external additives include particulate inorganic materials. It is preferable for the particulate inorganic materials to have a primary particle diameter of from 5 nm to 2 $\mu$m, and more preferably from 5 nm to 500 nm. In addition, it is preferable that the specific surface area of such particulate inorganic materials measured by a BET method is from 20 to 500 $m^2/g$. The content of the external additive is preferably from 0.01 to 5% by weight, and more preferably from 0.01 to 2.0% by weight, based on total weight of the toner composition.

Specific examples of such inorganic particulate materials include silica, alumina, titanium oxide, barium titanate, magnesium titanate, calcium titanate, strontium titanate, zinc oxide, tin oxide, quartz sand, clay, mica, sand-lime, diatom earth, chromium oxide, ceriumoxide, red iron oxide, antimony trioxide, magnesium oxide, zirconium oxide, barium sulfate, barium carbonate, calcium carbonate, silicon carbide, silicon nitride, etc.

Among these particulate inorganic materials, a combination of a hydrophobic silica and a hydrophobic titanium oxide is preferably used. In particular, when a hydrophobic silica and a hydrophobic titanium oxide each having an average particle diameter not greater than 50 nm are used as an external additive, the electrostatic force and van der Waals' force between the external additive and the toner particles are improved, and thereby the resultant toner composition has a proper charge quantity. In addition, even when the toner composition is agitated in a developing device, the external additive is hardly released from the toner particles, and thereby image defects such as white spots and image omissions are hardly produced. Further, the quantity of particles of the toner composition remaining on image bearing members can be reduced.

When particulate titanium oxides are used as an external additive, the resultant toner composition can stably produce toner images having a proper image density even when environmental conditions are changed. However, the charge rising properties of the resultant toner composition tend to deteriorate. Therefore the addition quantity of a particulate titanium oxide is preferably smaller than that of a particulate silica, and in addition the total addition amount thereof is preferably from 0.3 to 1.5% by weight based on weight of the toner particles not to deteriorate the charge rising properties and to stably produce good images without toner cloud (i.e., toner scattering).

Method of Manufacturing Modified Polyester Resin

Modified polyester resins for use as the binder resin of the toner composition of the present invention is prepared, for example, by the following method.

A polyol (1) and a polycarboxylic acid (2) are heated to a temperature of from 150 to 280° C. in the presence of a known catalyst such as tetrabutoxy titanate and dibutyltinoxide. Then water generated is removed, under a reduced pressure if desired, to prepare a polyester resin having a hydroxyl group.

Then the polyester resin is reacted with a polyisocyanate (3) at a temperature of from 40 to 140 C to prepare a prepolymer (A) having an isocyanate group. Further, the prepolymer (A) is reacted with an amine (B) at a temperature of from 0 to 140° C., to prepare a polyester resin having a urea bonding. When the polyester resin is reacted with the polyisocyanate (3), and the prepolymer (A) is reacted with the amine (B), a solvent can be used if desired.

Suitable solvents include solvents which do not react with the isocyanate (3). Specific examples of such solvents include aromatic solvents such as toluene and xylene; ketones such as acetone, methyl ethyl ketone and methyl isobutyl ketone; esters such as ethyl acetate; amides such as dimethylformamide and dimethylacetoaminde; ethers such as tetrahydrofuran.

When an unmodified polyester resin (ii), which does not have a urea bonding, is used in combination with the modified polyester resin (i), the unmodified polyester resin (ii) is prepared by a method similar to that used for preparing the polyester reins having a hydroxyl group, and the unmodified polyester resin (ii) is added to the solution of the modified polyester resin (i) after the reaction of forming the modified polyester resin (i) has completed.

The toner composition of the present invention can be manufactured by the following method, but the manufacturing method is not limited thereto.

Method for Manufacturing Toner in Aqueous Medium

The modified polyester resin for use in the present invention is defined as a polyester resin which includes a bonding other than an ester bonding or a polyester resin in which a different resin component is bonded by a covalent bonding or an ionic bonding. For example, polyester resins having a bonding other than an ester bonding at the end position thereof are exemplified. Specifically, the modified polyester resin include polyester resins which are prepared by reacting a functional group such as isocyanate group, which can react with an acid group or a hydroxyl group and which located at the end portion of a polyester resin, with a compound having an active hydrogen.

When a compound having plural active hydrogen atoms is used, polyester resins having a urea bonding or a urethane bonding can be prepared by reacting the compound with the end portions of two polyester resin molecules.

In addition, grafted polyester resins such as styrene-modified or acrylic-modified polyester resins, which are prepared by incorporating a double bonding into the main chain of a polyester resin and performing a radical polymerization to incorporate a graft component, can also be used as the modified polyester resin.

Further, polyester copolymers in which a different resin unit, such as a silicone resin having a carboxyl group, a hydroxyl group, an epoxy group or a mercapto group at the end portion, is copolymerized in the main chain of a polyester resin can also be used as the modified polyester resin.

Suitable aqueous medium for use in the toner manufacturing method of the present invention include water and mixtures of water with a solvent which can be mixed with water. Specific examples of such a solvent include alcohols (e.g., methanol, isopropanol and ethylene glycol), dimethylformamide, tetrahydrofuran, cellosolves (e.g., methyl cellosolve), lower ketones (e.g., acetone and methyl ethyl ketone), etc.

Mother toner particles can be prepared by reacting a dispersion, in which a prepolymer (A) having an isocyanate group is dispersed in an aqueous medium, with an amine (B). Alternatively, a urea-modified polyester resin which is previously prepared may be used.

In order to prepare a dispersion in which a urea-modified polyester resin (i) or a prepolymer (A) is stably dispersion in an aqueous medium, a method, in which toner constituents including a urea-modified polyester (i) or a prepolymer (A) are added into an aqueous medium and then dispersed upon application of shear stress, is preferably used. A prepolymer (A) and other toner constituents such as colorants, master batch pigments, release agents, charge controlling agents, unmodified polyester resins, etc. may be added into an aqueous medium at the same time when the dispersion is prepared. However, it is preferable that the toner constituents are previously mixed and then the mixed toner constituents are added to the aqueous liquid at the same time. In addition, colorants, release agents, charge controlling agents, etc., are not necessarily added to the aqueous dispersion before particles are formed, and may be added thereto after particles are prepared in the aqueous medium. A method in which particles, which are previously formed without a colorant, are dyed by a known dying method can also be used.

In the present invention, a charge controlling agent needs to be fixed on the surface of mother toner particles. The mother toner particles optionally includes a charge controlling agent therein.

The dispersion method is not particularly limited, and low speed shearing methods, high speed shearing methods, friction methods, high pressure jet methods, ultrasonic methods, etc. can be used. Among these methods, high speed shearing methods are preferable because particles having a particle diameter of from 2 $\mu$m to 20 $\mu$m can be easily prepared. At this point, the particle diameter (2 to 20 $\mu$m) means a particle diameter of particles including a liquid).

When a high speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 minutes. The temperature in the dispersion process is typically from 0 to 150° C. (under pressure), and preferably from 40 to 98° C. When the temperature is relatively high, a urea-modified polyester (i) or a prepolymer (A) can be easily dispersed because the dispersion has a low viscosity.

The weight ratio (T/M) of the toner constituents (T) (including a urea-modified polyester (i) or a prepolymer (A)) to aqueous medium (M) is typically from 100/50 to 100/2,000, and preferably from 100/100 to 100/1,000. When the ratio is too large (i.e., the quantity of the aqueous medium is small), the dispersion of the toner constituents in the aqueous medium is not satisfactory, and thereby the resultant mother toner particles do not have a desired particle diameter. In contrast, when the ratio is too small, the manufacturing costs increase.

A dispersant can be preferably used when a dispersion is prepared, to prepare a dispersion including particles having a sharp particle diameter distribution and to prepare a stable dispersion.

Specific examples of the dispersants, which can disperse or emulsify an oil phase, in which toner constituents are dispersed, in an aqueous liquid, include anionic surfactants such as alkylbenzene sulfonic acid salts, $\alpha$-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di)octylaminoethyle)glycin, and N-alkyl-N,N-dimethylammonium betaine.

By using a surfactant having a fluoroalkyl group, a dispersion having good dispersibility can be prepared even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6–C11)oxy}-1-alkyl(C3–C4) sulfonate, sodium 3-{omega-fluoroalkanoyl(C6–C8)-N-ethylamino}-1-propanesulfonate, fluoroalkyl(C11–C20) carboxylic acids and their metal salts, perfluoroalkylcarboxylic acids and their metal salts, perfluoroalkyl(C4–C12)sulfonate and their metal salts, perfluorooctanesulfonic acid diethanol amides, N-propyl-N-(2-hydroxyethyl)perfluorooctanesulfone amide, perfluoroalkyl(C6–C10) sulfoneamidepropyltrimethylammonium salts, salts of perfluoroalkyl (C6–C10)-N-ethylsulfonyl glycin, monoperfluoroalkyl(C6–C16)ethylphosphates, etc.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants, which can disperse an oil phase including toner constituents in water, include primary, secondary and tertiary aliphatic amines having a fluoroalkyl group, aliphatic quaternary ammonium salts such as perfluoroalkyl(C6–C10) sulfoneamidepropyltrimethylammonium salts, benzalkonium salts, benzetonium chloride, pyridinium salts, imidazolinium salts, etc. Specific examples of the marketed products thereof include SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

In addition, particulate polymers can also be used as a dispersant as well as inorganic dispersants such as calcium phosphate, sodium carbonate and sodium sulfate. Specific examples of the particulate polymers include particulate polymethyl methacylate having a particle diameter of from 1 to 3 μm, particulate polystyrene having a particle diameter of from 0.5 to 2 μm, particulate styrene-acrylonitrile copolymers having a particle diameter of 1 μm, PB-200H (from Kao Corp.) SGP (Soken Chemical & Engineering Co., Ltd.), TECHNOPOLYMER SB (Sekisui Plastics Co., Ltd.), SPG-3G (Soken Chemical & Engineering Co., Ltd.), and MICROPEARL (Sekisui Fine Chemical Co., Ltd.).

Further, it is possible to stably disperse toner constituents in water using a polymeric protection colloid in combination with the inorganic dispersants and/or particulate polymers mentioned above. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropylacrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

In order to prepare particles having a ratio Dv/Dn of from 1.00 to 1.20, it is needed to use a proper dispersant and a proper emulsifying device which can apply a uniform shear stress. Suitable emulsifying devices include HOMOMIXER and FILLMIX both of which are manufactured by Tokushu Kika Kogyo Co., Ltd. By using a proper dispersant and a proper emulsifying device, it becomes possible to prepare particles having a ratio Dv/Dn of from 1.00 to 1.20, and preferably from 1.00 to 1.15. When particles having a ratio Dv/Dn of from 1.00 to 1.20 and a spherical form, the resultant toner has good charge stability and can produce sharp images. When a toner is prepared by a conventional pulverization method, the toner typically has a ratio Dv/Dn of from 1.20 to 1.40. A toner having a ratio Dv/Dn of from 1.00 to 1.15 can be prepared by the method of the present invention as well as a toner having a ratio Dv/Dn of from 1.00 to 1.20.

In the present invention, it is needed to prepare particles having a proper spherical degree as well as a proper particle diameter distribution by using a proper dispersant and a proper emulsifying device. The spherical degree is preferably not less than 0.960. In order to prepare particles having such a spherical degree, the key point is the solvent removing conditions when the solvent is removed after the particles are prepared. Specifically, when the solid content of the oil phase is low and the solvent removing speed is fast, the resultant particles have concavo-convex surface because the particles causes bulk shrinkage. Therefore, in order to prepare particles having a spherical degree not less than 0.960, it is preferable to heighten the solid content of the oil phase and to slowly remove the solvent in the solvent removing process. The solid content is preferably from 20 to 60% to prepare particles having a spherical degree not less than 0.960. When the solid content is too high, it is hard to control the particle diameter.

In this case, when compounds such as calcium phosphate which are soluble in an acid or alkali are used as a dispersion stabilizer, it is preferable to dissolve calcium phosphate by adding an acid such as hydrochloric acid and to wash the resultant particles with water to remove calcium phosphate therefrom. In addition, calcium phosphate can be removed using a zymolytic method.

When a dispersant is used, the resultant particles are preferably washed after the particles are subjected to an elongation and/or a crosslinking reaction to impart good charge ability to the mother toner particles.

When an aqueous dispersion or emulsion is prepared, a solvent which can dissolve the urea-modified polyester (i) or prepolymer (A) used is preferably used because the resultant particles have a sharp particle diameter distribution. The solvent is preferably volatile and has a boiling point lower than 100° C. because of easily removed from the dispersion after the particles are formed.

Specific examples of such a solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used.

The addition quantity of such a solvent is from 0 to 300 parts by weight, preferably from 0 to 100, and more preferably from 25 to 70 parts by weight, per 100 parts by weight of the prepolymer (A) used. When such a solvent is used to prepare a particle dispersion, the solvent is removed therefrom upon application of heat thereto under a normal or reduced pressure after the particles are subjected to an elongation reaction and/or a crosslinking reaction.

When the thus prepared toner particles have a wide particle diameter distribution even after the particles are subjected to a washing treatment and a drying treatment, the toner particles are preferably subjected to a classification treatment using a cyclone, a decanter or a method utilizing centrifuge to remove fine particles therefrom. However, it is preferable to subject the liquid including the particles to the classification treatment in view of efficiency. The toner particles having an undesired particle diameter can be reused as the raw materials for the kneading process. Such toner particles for reuse may be in a dry condition or a wet condition.

The dispersant used is preferably removed from the particle dispersion. The dispersant is preferably removed from the dispersion when the classification treatment is performed.

The thus prepared mother toner particles are then mixed with a charge controlling agent, upon application of mechanical impact thereto to fix the charge controlling agent on the mother toner particles (i.e., to integrate the charge controlling agent into the mother toner particle). Thus the charge controlling agent is prevented from being released from the mother toner particles.

Specific examples of such mechanical impact application methods include methods in which a mixture is mixed with a highly rotated blade and methods in which a mixture is put into a jet air to collide the particles against each other or a collision plate.

Specific examples of such mechanical impact applicators include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc. However, it is preferable to use Henshel mixers or Q-form mixers. When a Q-form mixer is used to mix a charge controlling agent and mother toner particles, the revolution of the rotor is preferably from 40 to 150 m/sec. When a charge controlling agent and mother toner particles are mixed under such conditions, it seems that the charge controlling agent is micronized and then fixed on the surface of the mother particles. This is not determined even when the resultant toner particles are observed by an electron microscope. However, when the toner particles are analyzed by XPS to determine whether the charge controlling agent is present on the surface of the mother toner particles, it is confirmed that almost all the charge controlling agent is present on the surface of the mother toner particles.

The fixation state of the charge controlling agent can be determined by measuring the specific surface area of the mother toner particles and the specific surface area of the toner particles on which the charge controlling agent is fixed.

Namely, just after the charge controlling agent is adhered on the mother toner particles, the specific surface area is large, and as the fixation of the charge controlling agent proceeds, the specific surface area decreases. When the charge controlling agent is perfectly embedded in the mother toner particles, the specific surface area is almost the same as that of the mother toner particles. When the increase in specific surface area is within 10%, it is considered that the charge controlling agent is fixed on the mother toner particles. In this case, the charge controlling agent has a particle diameter one tenth of that of the mother toner particles and the addition amount thereof is not less than 0.01% based on weight of the mother toner particles.

Carrier for Tow-Component Developer

The toner of the present invention can be used for a two-component developer in which the toner is mixed with a magnetic carrier. The weight ratio (T/C) of the toner (T) to the carrier (C) is preferably from 1/100 to 10/100.

Suitable carriers for use in the two component developer include known carrier materials such as iron powders, ferrite powders, magnetite powders, magnetic resin carriers, which have a particle diameter of from about 20 to about 200 $\mu$m. The surface of the carriers may be coated by a resin.

Specific examples of such resins to be coated on the carriers include amino resins such as urea-formaldehyde resins, melamine resins, benzoguanamine resins, urea resins, and polyamide resins, and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins.

If desired, an electroconductive powder may be included in the toner. Specific examples of such electroconductive powders include metal powders, carbon blacks, titanium oxide, tin oxide, and zinc oxide. The average particle diameter of such electroconductive powders is preferably not greater than 1 $\mu$m. When the particle diameter is too large, it is hard to control the resistance of the resultant toner.

The toner of the present invention can also be used as a one-component magnetic developer or a one-component non-magnetic developer.

Then the image forming apparatus of the present invention will be explained referring to FIGS. 1 and 2.

FIG. 1 is a schematic view illustrating an embodiment of the image forming apparatus of the present invention.

Numeral 1 denotes a photoreceptor which rotates in a direction indicated by an arrow A. The photoreceptor 1 is charged with a charger 2. Then imagewise light 3 irradiates the charged photoreceptor 1 to form an electrostatic latent image thereon. The electrostatic latent image is developed with a developer which includes a toner and which is born on a developing roller 41 to from a toner image on the photoreceptor 1. The toner is the toner of the present invention.

Then the toner image is transferred onto a receiving material P which is timely fed by a registration roller 7 toward a nip between the photoreceptor 1 and a transfer belt 5.

The surface of the photoreceptor 1 is cleaned by a cleaner 6 including a cleaning brush 62 and a cleaning blade 62 after the toner image is transferred onto the receiving material P. A discharge lamp 9 irradiates the surface of the photoreceptor with light to reduce the residual charges of the photoreceptor 1.

A developing unit 4 includes rollers 42, 44, 46 and 47 and a paddle 43, which feed the developer to the developing roller 41 while agitating the developer.

Figure 2:
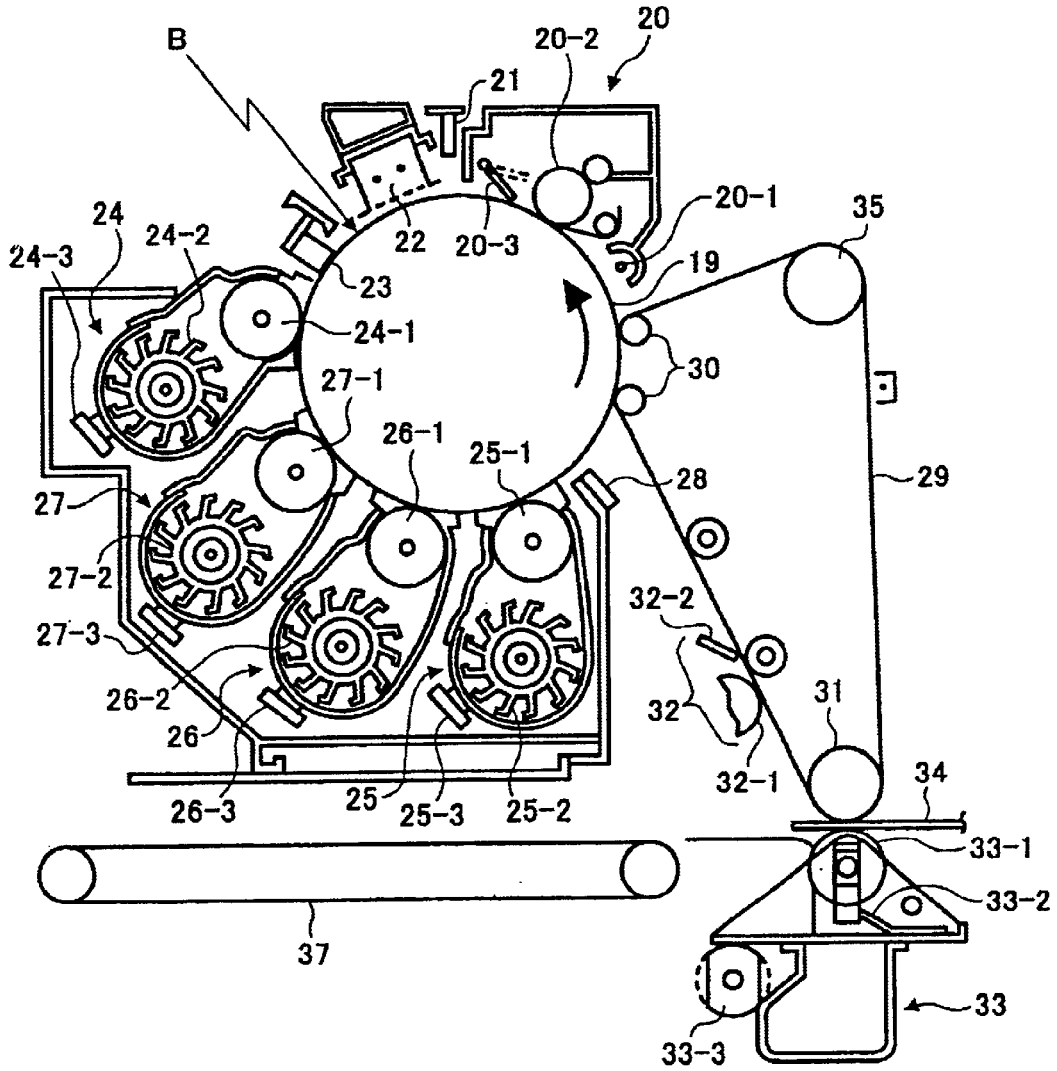
FIG. 2 a schematic view illustrating a main portion of another embodiment of the image forming apparatus of the present invention.

FIG. 2 is a schematic view illustrating another embodiment of the image forming apparatus of the present invention.

Numeral 19 denotes a photoreceptor which rotates in the counterclockwise direction indicated by an arrow. Around the photoreceptor 19, a cleaning unit 20 which includes a pre-cleaning discharger 20-1, a cleaning roller 20-2 and a cleaning blade 20-3 and which cleans the surface of the photoreceptor 19; a discharge lamp 21 which discharges charges remaining on the photoreceptor 19; a charger 22 which charges the photoreceptor 19; a potential sensor 23; a black (BK) image developer 24; a cyan (C) image developer 25; a magenta (M) image developer 26; a yellow (Y) image developer 27; a developing density pattern detector 28; and an intermediate transfer medium 29, are arranged.

Each image developer 24, 25, 26 or 27 is constructed of a developing sleeve (24-1, 25-1, 26-1 or 27-1) which rotates to carry a developer such that each developer faces the photoreceptor 19; a paddle (24-2, 25-2, 26-2 or 27-2) which rotates to scoop up and agitate each developer; and a toner concentration detecting sensor (24-3, 25-3, 26-3 or 27-3) which detects the toner concentration of each developer. The image developers 24, 25, 26 and 27 include respective BK, C, M and Y developers including BK, C, M and Y toners, respectively. The toners are the toner of the present invention.

Then the image forming process will be explained in detail when BK, C, M and Y images are formed in this order. The developing order is not limited thereto.

When a coping operation is started, a laser beam B irradiates the photoreceptor 19 according to the BK image data, which are prepared by reading an original image using a color scanner (not shown) to form a BK latent image thereon. The developing sleeve 24-1 starts to rotate before the tip of the BK latent image reaches the developing position in the BK image developer 24 to develop the BK latent image with the BK toner. This developing operation is continued until the rear end of the BK latent image passes the developing position. The BK image developer 24 achieves a dormant state before the C developing operation is started.

The BK toner image formed on the photoreceptor 19 is transferred onto the intermediate transfer belt 29 which is fed at the same speed as that of the photoreceptor 19. Hereinafter this toner transfer is referred to as the first transfer. The first transfer is performed while the photoreceptor 19 is contacted with the intermediate transfer belt 29 and a predetermined bias voltage is applied to a first transfer bias roller 30. Similarly to the BK first transfer, C, M and Y first transfers are performed such that the BK, C, M and Y toner images (i.e., a full color image) are formed on the proper positions of the intermediate transfer belt 29. All of the thus prepared four color images are then transferred onto a receiving paper 34 at once. Thus a full color image is formed on the receiving paper 34.

The BK image forming process is followed by a C image forming process. A laser beam B irradiates the photoreceptor 19 according to the C image data, which are prepared by reading the original image using the color scanner (not shown) to form a C latent image thereon. The developing sleeve 25-1 starts to rotate to elect the C developer after the rear end of the BK latent image passes the developing position in the C image developer 25 and before the tip of the C latent image reaches the developing position. Thus, the C latent image is developed with the C toner which has a charge quantity larger than the Bk toner. This C developing operation is continued until the rear end of the C latent image passes the C developing position. Similarly to the BK developing operation, the C image developer 25 achieves a dormant state (i.e., the ears of the C developer are laid) before the M developing operation is started.

The M and Y image developing operations are performed in the same way as performed in the BK and C image developing operations. In this case, the M toner has a charge quantity larger than the C toner, and the Y toner has a charge quantity larger than the M toner.

Then the intermediate transfer belt unit will be explained in detail.

The intermediate transfer belt 29 bears the BK, C, M and Y images thereon, and is tightened by a drive roller 31, the first transfer bias roller 30, and a driven roller 35. The intermediate transfer belt 29 is driven by a stepping motor (not shown).

A belt cleaning unit 32 is constituted of a brush roller 32-1 and a rubber blade 32-2, and is touched to and detached from the intermediate transfer belt 29 by a touch/detach mechanism (not shown). After the BK image is transferred onto the intermediate transfer belt 29, the belt cleaning unit 32 is detached from the intermediate transfer belt 29 during the C, M and Y first transfers. After the second transfer, the belt cleaning unit 32 is touched to the intermediate transfer belt 29 to clean the surface of the intermediate transfer belt 29.

A paper transfer unit 33 is constituted of a paper transfer bias roller 33-1, a roller cleaning blade 33-2, and a belt touch/detach mechanism 33-3 configured to touch (or detach) the paper transfer unit 33 to (from) the intermediate transfer belt 29. The bias roller 33-1 is ordinarily separated from the intermediate transfer belt 29. When the four color images (i.e., the full color image) formed on the intermediate transfer belt 29 are transferred onto the receiving material 34 at once, the receiving paper 34 is timely pressed by the belt touch/detach mechanism 33-3 to transfer the color images onto the proper position of the receiving paper 34 while a bias voltage is applied to the receiving paper 34 by the roller 33-1.

Then the receiving paper 34 is timely fed by a paper feeding unit 37 to a fixer (not shown). In the fixer, the color images on the receiving paper 34 are fixed at a nip between a fixing roller, which is controlled so as to have a predetermined temperature and a pressure roller. Thus a full color copy is prepared.

After the first transfer, the photoreceptor 19 is cleaned by the cleaning unit 20, and then discharged uniformly by the discharge lamp 21.

After transferring the color toner images onto the receiving paper 34, the intermediate transfer belt 29 is cleaned by the cleaning unit 32 which is again contacted to the intermediate transfer belt 29 by the touch/detach mechanism.

When the copying operation is repeated, the BK image forming process of the second copy is timely performed after the Y image forming process of the first copying operation. On the cleaned area of the intermediate transfer belt 29, the BK image of the second copy is transferred. The C, M and Y images of the second copy are also transferred onto the intermediate transfer belt 29 in the same way as performed for the first copy.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

(Preparation of Toner Binder)

In a reaction container having a condenser, a stirrer and a pipe from which a nitrogen gas was supplied to the container, 690 parts of an adduct of bisphenol A with 2 moles of ethyleneoxide, 256 parts of isophthalic acid and 2 parts of dibutyl tin oxide were mixed. Then the mixture was reacted for 8 hours at 230° C. under a normal pressure. Then the reaction was further performed for 5 hours under a reduced pressure of from 10 to 15 mmHg. After the reaction product was cooled to 160° C., 18 parts of phthalic anhydride were added thereto to further perform a reaction for 2 hours. Then the reaction product was cooled to 80° C. The reaction product was mixed with 188 parts of isophorondiisocyanate in ethyl acetate and reacted for 2 hours to prepare a prepolymer (1) having an isocyanate group.

Then 267 parts of the thus synthesized prepolymer (1) were reacted with 14 parts of isophoronediamine for 2 hours at 50° C. Thus, a urea-modified polyester (1) was prepared.

Similarly, 690 parts of an adduct of bisphenol A with 2 moles of ethyleneoxide and 256 parts of terephthalic acid were condensation-polymerized for 8 hours at 230° C. under a normal pressure. Then the reaction was further performed for 5 hours under a reduced pressure of from 10 to 15 mmHg to prepare an unmodified polyester (a).

Then 100 parts of the urea-modified polyester (1) and 900 parts of the polyester (a) were dissolved in 1,800 parts of ethyl acetate to prepare a solution of a toner binder resin (1) (i e., a mixture of the polyesters (1) and (a)). Apart of the solution was dried to prepare a dry toner binder resin (1). The glass transition temperature was 62° C.

(Preparation of Toner Particles)

In a beaker, 210 parts of the solution of the toner binder resin (1), 10 parts of a rice wax and 4 parts of a copper phthalocyanine blue pigment were mixed. The mixture was agitated at 60° C. by a TK HOMOMIXER at a revolution of 12,000 rpm to prepare a dispersion.

Then, 265 parts of deionized water, 260 parts of a 10% aqueous solution of tricalcium phosphate and 0.2 parts of sodium dodecylbenzenesulfonate were added to the dispersion to emulsify. The mixture was heated to 60° C. and agitated for 10 minutes by a TK HOMOMIXER at a revolution of 12,000 rpm to prepare a suspension. Then 500 parts of the suspension was contained in a container having a stirrer and a thermometer and heated at a temperature of from 40 to 50° C. for 60 minutes under a reduced pressure to remove the solvent. Then the dispersion was filtered, and the resultant particles were washed with water, dried, and classified to prepare mother toner particles.

Then the following components were mixed in a Q-form mixer manufactured by Mitsui Mining Co., Ltd.

| | |
|---|---|
| The colored mother particles prepared above | 100 |
| Charge controlling agent | 0.25 |

(BONTRON E-84)

The mixing conditions were as follows:

Rotation speed of turbine blade: 50 m/s

Mixing operation: 5 cycles of a mixing operation for 2 minutes followed by a pause for 1 minute Thus, toner particles were prepared.

Then 0.5 parts of a hydrophobic silica (H2000 manufactured by Clariant Japan K.K.) were added to the toner particles and the mixture was mixed in the Q-form mixer under the following conditions:

Rotation speed of turbine blade: 15 m/s

Mixing operation: 5 cycles of a mixing operation for 30 seconds followed by a pause for 1 minute Thus, a cyan toner composition (1) of the present invention was prepared.

Example 2

(Preparation of Toner Binder)

Similarly to the method performed in Example 1, 314 parts of an adduct of bisphenol A with 2 moles of ethyleneoxide, 314 parts of 256 parts of bisphenol A with 2 moles of propyleneoxide, 274 parts of isophthalic acid and 20 parts of trimellitic anhydride were subjected to a polycondensation reaction. After the reaction, the reaction product was mixed with 154 parts of isophorondiisocyanate to prepare a prepolymer (2) having an isocyanate group.

Then 213 parts of the thus synthesized prepolymer (2) were reacted with 9.5 parts of isophoronediamine and 0.5 parts of dibutylamine similarly to the method performed in Example 1. Thus, a urea-modified polyester (2) was prepared.

Similarly, 670 parts of an adduct of bisphenol A with 3 moles of ethyleneoxide, 230 parts of terephthalic acid and 35 parts of maleic acid were condensation-polymerized for 10 hours at 210° C. under a normal pressure. Then the reaction was further performed for 5 hours under a reduced pressure of from 10 to 15 mmHg to prepare an unmodified polyester (b).

Then 200 parts of the urea-modified polyester (2) and 800 parts of the polyester (b) were dissolved in 1,000 parts of ethyl acetate to prepare a solution of a toner binder resin (2) (i.e., a mixture of the polyesters (2) and (b)). A part of the solution was dried to prepare a dry toner binder resin (2). The glass transition temperature was 64° C.

(Preparation of Toner Composition)

The procedure for preparation of the toner composition in Example 1 was repeated except that the toner binder resin (1) was replaced with the toner binder resin (2).

Thus, a cyan toner composition (2) of the present invention was prepared.

Example 3

(Preparation of Toner Binder)

Thirty (30) parts of the urea-modified polyester resin (1) and 970 parts of the unmodified polyester resin (a) were dissolved in 2,000 parts of ethyl acetate to prepare an ethyl acetate solution of a toner binder (3). A part of the solution was dried to prepare a dry toner binder resin (3).

(Preparation of Toner Composition)

The procedure for preparation of the toner composition in Example 1 was repeated except that the toner binder resin (1) was replaced with the toner binder resin (3).

Thus, a cyan toner composition (3) of the present invention was prepared.

Example 4

(Preparation of Toner Binder)

Five hundred (500) parts of the urea-modified polyester resin (1) and 500 parts of the unmodified polyester resin (a) were dissolved in 900 parts of ethyl acetate to prepare an ethyl acetate solution of a toner binder (4). A part of the solution was dried to prepare a dry toner binder resin (4).

(Preparation of Toner Composition)

In a beaker, 210 parts of the solution of the toner binder resin (4), 50 parts of a rice wax, and 4 parts of a copper phthalocyanine blue pigment were contained. The mixture was agitated by a TK HOMOMIXER at a revolution of 12,000 rpm to prepare a dispersion.

Then, 265 parts of deionized water, 260 parts of a 10% aqueous solution of tricalcium phosphate and 0.2 parts of sodium dodecylbenzenesulfonate were added to the dispersion to emulsify. The mixture was heated to 60° C., and then agitated for 10 minutes by a TK HOMOMIXER at a revolution of 12,000 rpm to prepare a suspension. Then 500 parts of the suspension was contained in a container having a stirrer and a thermometer and heated at a temperature of from 50 to 60° C. for 50 to 60 minutes under a reduced pressure to remove the solvent. Then the dispersion was filtered, and the resultant particles were washed with water, dried, and air-classified to prepare mother toner particles.

Then the procedure for preparation of the toner composition (1) in Example 1 was repeated except that the above-prepared mother toner particles were used, to prepare a cyan toner (4) of the present invention.

Example 5

(Preparation of Toner Binder)

One hundred (100) parts of the urea-modified polyester resin (1) and 900 parts of the unmodified polyester resin (a) were dissolved in 1,500 parts of ethyl acetate to prepare an ethyl acetate solution of a toner binder (5). A part of the solution was dried to prepare a dry toner binder resin (5).

(Preparation of Toner Composition)

The procedure for preparation of the toner composition in Example 1 was repeated except that the toner binder resin (1) was replaced with the toner binder resin (5).

Thus, a cyan toner composition (5) of the present invention was prepared.

Example 6

(Preparation of Toner Binder)

One hundred (100) parts of the urea-modified polyester resin (1) and 900 parts of the unmodified polyester resin (b) were dissolved in 1,500 parts of ethyl acetate to prepare an ethyl acetate solution of a toner binder (6) A part of the solution was dried to prepare a dry toner binder resin (6).

(Preparation of Toner Composition)

The procedure for preparation of the toner composition in Example 4 was repeated except that the toner binder resin (4) was replaced with the toner binder resin (6).

Thus, a cyan toner composition (6) of the present invention was prepared.

When the cross section of particles of the toner composition (6) was observed by a transmission electron microscope (TEM), it was found that a wax is dispersed in the particles.

Example 7

(Preparation of Toner Binder)

Nine hundred and twenty four (924) parts of an adduct of bisphenol A with 2 moles of ethyleneoxide and 276 parts of terephthalic acid were condensation-polymerized for 8 hours at 230° C. under a normal pressure. Then the reaction was further performed for 5 hours under a reduced pressure of from 30 to 50 mmHg to prepare an unmodified polyester (c).

Then 100 parts of the urea-modified polyester (1) and 900 parts of the polyester (c) were dissolved in 2,000 parts of ethyl acetate to prepare a solution of a toner binder resin (7). A part of the solution was dried to prepare a dry toner binder resin (7).

(Preparation of Toner Composition)

The procedure for preparation of the toner composition in Example 6 was repeated except that the toner binder resin (6) was replaced with the toner binder resin (7).

Thus, a cyan toner composition (7) of the present invention was prepared.

Example 8

(Preparation of Toner Binder)

Eight hundred and twenty four (824) parts of an adduct of bisphenol A with 2 moles of ethyleneoxide and 276 parts of terephthalic acid were condensation-polymerized for 8 hours at 210° C. under a normal pressure. Then the reaction was further performed for 5 hours under a reduced pressure of from 5 to 20 mmHg to prepare an unmodified polyester (d) having a molecular weight distribution in which a peak is observed at 5,000.

Then 100 parts of the urea-modified polyester (1) and 900 parts of the polyester (d) were dissolved in 2,000 parts of a mixture solvent of ethyl acetate and methyl ethyl ketone (mixing ratio of 1/1) to prepare a solution of a toner binder resin (8). A part of the solution was dried to prepare a dry toner binder resin (8).

(Preparation of Toner Composition)

The procedure for preparation of the toner composition in Example 6 was repeated except that the toner binder resin (6) was replaced with the toner binder resin (8).

Thus, a cyan toner composition (8) of the present invention was prepared.

Example 9

(Preparation of Toner Binder)

Seven hundred and twenty four (724) parts of an adduct of bisphenol A with 2 moles of ethyleneoxide and 276 parts of terephthalic acid were condensation-polymerized for 8 hours at 230° C. under a normal pressure. Then the reaction was further performed for 5 hours under a reduced pressure of from 10 to 15 mmHg. The reaction product was cooled to 160° C., and then reacted with 32 parts of trimellitic anhydride for 2 hours to prepare an unmodified polyester (e) having a molecular weight distribution in which a peak is observed at 5,000.

Then 100 parts of the urea-modified polyester (1) and 900 parts of the polyester (e) were dissolved in 2,000 parts of ethyl acetate to prepare a solution of a toner binder resin (9). A part of the solution was dried to prepare a dry toner binder resin (9).

(Preparation of Toner Composition)

The procedure for preparation of the toner composition in Example 1 was repeated except that the toner binder resin (1) was replaced with the toner binder resin (9).

Thus, a cyan toner composition (9) of the present invention was prepared.

Example 10

(Preparation of Toner Binder)

Seven hundred and twenty four (724) parts of an adduct of bisphenol A with 2 moles of ethyleneoxide and 276 parts of terephthalic acid were condensation-polymerized for 8 hours at 230° C. under a normal pressure. Then the reaction was further performed for 5 hours under a reduced pressure of from 10 to 15 mmHg. The reaction product was cooled to 160° C., and then reacted with 48 parts of trimellitic anhydride for 2 hours to prepare an unmodified polyester (f) having a molecular weight distribution in which a peak is observed at 5,000.

Then 100 parts of the urea-modified polyester (1) and 900 parts of the polyester (f) were dissolved in 2,000 parts of ethyl acetate to prepare a solution of a toner binder resin (10). A part of the solution was dried to prepare a dry toner binder resin (10).

(Preparation of Toner Composition)

The following components were mixed using a flusher.

| | |
|---|---|
| Water | 600 |
| Aqueous cake of Pigment Red 57 (solid content of 50 %) | 1200 |

The mixture was mixed with 1200 parts of a polyester resin having an acid value of 3, a hydroxyl value of 25, a number average molecular weight (Mn) of 3,500, a ratio (Mw/Mn) of 4.0 and a glass transition temperature Tg of 60 C. The mixture was kneaded at 150° C. for 30 minutes. Then the kneaded mixture was mixed with 1,000 parts of xylene and the mixture was further kneaded for 1 hour. After water and xylene were removed therefrom, the mixture was cooled by rolling, pulverized by a pulverizer and passed through a three roll mill twice. Thus a magenta master batch pigment was prepared.

The procedure for preparation of the toner composition in Example 1 was repeated except that 4 parts of the copper phthalocyanine blue pigment were replaced with 8 parts of the above-prepared magenta master batch pigment and the toner binder resin (1) was replaced with the toner binder resin (10).

Thus, a magenta toner composition (10) of the present invention was prepared.

Example 11

(Preparation of Toner Binder)

Seven hundred and twenty four (724) parts of an adduct of bisphenol A with 2 moles of ethyleneoxide and 276 parts of terephthalic acid were condensation-polymerized for 2 hours at 230° C. under a normal pressure. Then the reaction was further performed for 5 hours under a reduced pressure of from 10 to 15 mmHg to prepare an unmodified polyester (g) having a molecular weight distribution in which a peak is observed at 1,000.

Then 100 parts of the urea-modified polyester (1) and 900 parts of the polyester (g) were dissolved in 2,000 parts of ethyl acetate to prepare a solution of a toner binder resin (11). A part of the solution was dried to prepare a dry toner binder resin (11).

(Preparation of Toner Composition)

The procedure for preparation of the toner composition in Example 1 was repeated except that the toner binder resin (1) was replaced with the toner binder resin (11).

Thus, a cyan toner composition (11) of the present invention was prepared.

Example 12

(Preparation of Toner Binder)

Seven hundred and twenty four (724) parts of an adduct of bisphenol A with 2 moles of ethyleneoxide and 276 parts of terephthalic acid were condensation-polymerized for 6 hours at 210° C. under a normal pressure. Then the reaction was further performed for 5 hours under a reduced pressure of from 10 to 15 mmHg to prepare an unmodified polyester (h).

Then 100 parts of the urea-modified polyester (1) and 900 parts of the polyester (h) were dissolved in 2,000 parts of ethyl acetate to prepare a solution of a toner binder resin (12). A part of the solution was dried to prepare a dry toner binder resin (12).

(Preparation of Toner Composition)

The procedure for preparation of the toner composition in Example 1 was repeated except that the toner binder resin (1) was replaced with the toner binder resin (12).

Thus, a cyan toner composition (12) of the present invention was prepared.

Example 13

(Preparation of Prepolymer)

In a reaction container having a condenser, a stirrer and a pipe from which a nitrogen gas was supplied to the container, 800 parts of an adduct of bisphenol A with 2 moles of ethyleneoxide, 200 parts of isophthalic acid, 50 parts of terephthalic acid and 2 parts of dibutyl tin oxide were mixed. Then the mixture was reacted for 8 hours at 230° C. under a normal pressure. Then the reaction was further performed for 5 hours under a reduced pressure of from 10 to 15 mmHg while generated water was removed. After the reaction product was cooled to 160° C., 32 parts of phthalic anhydride were added thereto to further perform a reaction for 2 hours. Then the reaction product was cooled to 80 C. The reaction product was mixed with 170 parts of isophorondiisocyanate in ethyl acetate and reacted for 2 hours to prepare a prepolymer (3) having an isocyanate group.

(Preparation of Ketimine Compound)

In a reaction container having a stirrer and a thermometer, 30 parts of isphoronediamine and 70 parts of methyl ethyl ketone were mixed and reacted at 50° C. for 5 hours. Thus, a ketimine compound (1) was prepared.

(Preparation of Toner Composition)

In a beaker, 15.4 parts of the prepolymer (3), 60 parts of the unmodified polyester resin (a) and 78.6 parts of ethyl acetate were mixed while stirring to dissolve the prepolymer (3) and the unmodified polyester resin (a). Then 10 parts of a rice wax having a melting point of 83° C., which serves as a release agent, and 4 parts of copper phthalocyanine blue pigment were added thereto and the mixture was agitated at 60° C. by a TK HOMOMIXER, which was rotated at a revolution of 12,000 rpm, to prepare a dispersion. Finally, 2.7 parts of the ketimine compound (1) were added thereto to be dissolved therein. Thus, a toner constituent solution (1) was prepared.

On the other hand, 306 parts of deionized water, 265 parts of a 10% aqueous solution of tricalcium phosphate and 0.2 parts of sodium dodecylbenzenesulfonate were mixed in a container to prepare a solution. The mixture was heated to 60° C., and then the above-prepared toner constituent solution (1) was added thereto while the mixture was agitated for 10 minutes by a TK HOMOMIXER at a revolution of 12,000 rpm. Then 500 parts of the mixture was contained in a container having a stirrer and a thermometer and heated to 45° C. under a reduced pressure to perform an urea reaction while removing the solvent. Then the dispersion was filtered, and the resultant particles were washed with water, dried, and classified to prepare mother toner particles.

Then a toner composition (13) was prepared in the same was as performed in Example 1 using the mother toner particles prepared above.

Thus, a cyan toner composition (13) of the present invention was prepared.

Example 14

(Preparation of Prepolymer)

In a reaction container having a condenser, a stirrer and a pipe from which a nitrogen gas was supplied to the container, 856 parts of an adduct of bisphenol A with 2 moles of ethyleneoxide, 216 parts of isophthalic acid, 14 parts of terephthalic acid and 2 parts of dibutyl tin oxide were mixed. Then the mixture was reacted for 6 hours at 230° C. under a normal pressure. Then the reaction was further performed for 5 hours under a reduced pressure of from 50 to 100 mmHg while generated water was removed. After the reaction product was cooled to 160° C., 32 parts of phthalic anhydride were added thereto to further perform a reaction for 2 hours. Then the reaction product was cooled to 80° C. The reaction product was mixed with 170 parts of isophorondiisocyanate in ethyl acetate and reacted for 2 hours to prepare a prepolymer (4) having an isocyanate group.

(Preparation of Ketimine Compound)

In a reaction container having a stirrer and a thermometer, 30 parts of isphoronediamine and 70 parts of methyl ethyl ketone were mixed and reacted at 50° C. for 5 hours. Thus, a ketimine compound (1) was prepared.

(Preparation of Toner Composition)

In a beaker, 15.4 parts of the prepolymer (4), 50 parts of the unmodified polyester resin (a) and 95.2 parts of ethyl acetate were mixed while stirring to dissolve the prepolymer (4) and the unmodified polyester resin (a). Then 20 parts of a carnauba wax having a molecular weight of 1800, an acid value of 2.5 mgKOH/g and a penetration of 1.5 mm at 40° C., and 3 parts copper phthalocyanine blue pigment were added thereto and the mixture was agitated at 85° C. by a TK HOMOMIXER, which was rotated at a revolution of 12,000 rpm, to prepare a dispersion. Finally, 2.7 parts of the ketimine compound (1) were added thereto to be dissolved therein. Thus, a toner constituent solution (2) was prepared.

On the other hand, 465 parts of deionized water, 245 parts of a 10% aqueous solution of sodium carbonate and 0.4 parts of sodium dodecylbenzenesulfonate were mixed in a container to prepare a solution. The mixture was heated to 60° C., and then the above-prepared toner constituent solution (2) was added thereto while the mixture was agitated for 10 minutes by a TK HOMOMIXER at a revolution of 12,000 rpm. Then 500 parts of the mixture was contained in a container having a stirrer and a thermometer and heated to 60° C. under a reduced pressure to perform a urea reaction for a time of from 50 to 60 minutes while removing the solvent. Then the dispersion was filtered, and the resultant particles were washed with water, dried, and classified to prepare mother toner particles. In this case, the concentration of the dispersion was 13%.

Then a toner composition (14) was prepared in the same was as performed in Example 1 using the mother toner particles prepared above.

Example 15

(Preparation of Prepolymer)

In a reaction container having a condenser, a stirrer and a pipe from which a nitrogen gas was supplied to the container, 123 parts of an adduct of bisphenol A with 2 moles of ethyleneoxide, 150 parts of isophthalic acid and 2 parts of dibutyl tin oxide were mixed. Then the mixture was reacted for 8 hours at 230° C. under a normal pressure. Then the reaction was further performed for 5 hours under a reduced pressure of from 10 to 15 mmHg while generated water was removed. Then the reaction product was cooled to 160° C. Thus, a prepolymer (5) having a hydroxyl group was prepared.

(Preparation of Unmodified Polymer)

In a reaction container having a condenser, a stirrer and a pipe from which a nitrogen gas was supplied to the container, 589 parts of an adduct of bisphenol A with 2 moles of ethyleneoxide and 464 parts of dimethyl terephthalate were mixed. Then the mixture was reacted for 6 hours at 230° C. under a normal pressure. Then the reaction was further performed for 5 hours under a reduced pressure of from 10 to 15 mmHg. Thus, an unmodified polymer (I) was prepared.

(Preparation of Toner Composition)

In a beaker, 15.3 parts of the prepolymer (5), 63.6 parts of the dead polymer (I), 40 parts of toluene and 40 parts of ethyl acetate were mixed while stirring to dissolve the prepolymer (5) and the dead polymer (I). Then 10 parts of a rice wax, and 4 parts of a copper phthalocyanine blue pigment were added thereto and the mixture was agitated at 60° C. by a TK HOMOMIXER, which was rotated at a revolution of 12,000 rpm, to prepare a dispersion. Finally, 1.1 parts of diphenylmethane diisocyanate serving as an elongation agent were added thereto to be dissolved therein. Thus, a toner constituent solution (3) was prepared.

On the other hand, 406 parts of deionized water, 294 parts of a 10% aqueous suspension of tricalcium phosphate and 0.2 parts of sodium dodecylbenzenesulfonate were mixed in a container to prepare a solution. The mixture was heated to 60° C., and then the above-prepared toner constituent solution (3) was added thereto while the mixture was agitated for 10 minutes by a TK HOMOMIXER at a revolution of 12,000 rpm. Then 500 parts of the mixture was contained in a container having a stirrer and a thermometer and heated to 50° C. while consuming a time of 30 minutes. Thus, a urea reaction was performed for a time of from 50 to 60 minutes while removing the solvent. Then the dispersion was filtered, and the resultant particles were washed with water, dried, and air-classified to prepare mother toner particles.

Then a toner composition ($_1$5) was prepared in the same was as performed in Example 1 using the mother toner particles prepared above.

Comparative Example 1

(Preparation of Toner Binder)

In a reaction container having a condenser, a stirrer and a pipe from which a nitrogen gas was supplied to the container, 395 parts of an adduct of bisphenol A with 2 moles of ethyleneoxide, 166 parts of isophthalic acid and 2 parts of dibutyl tin oxide were mixed and reacted to prepare a comparative toner binder resin (1).

(Preparation of Toner Composition)

In a beaker, 100 parts of the comparative toner binder resin (1), 180 parts of ethyl acetate, 4 parts of a copper phthalocyanine blue pigment, 294 parts of a 10% aqueous solution of hydroxyapatite (SUPERTITE 10 from Nippon Chemical Industrial Co., Ltd.) serving as a dispersant, 706 parts of deionized water and 0.2 parts of sodium dodecylbenzenesulfonate serving as a dispersant were mixed and the mixture was agitated at 50° C. by a TK HOMOMIXER, which was rotated at a revolution of 12,000 rpm, to prepare a dispersion.

Then the procedure for preparation of the mother toner particles in Example 1 was repeated except that the solvent removing process was performed while consuming 8 hours.

Then a comparative toner composition (1) was prepared by mixing 100 parts of the mother toner particles prepared above, 0.3 parts of a hydrophobic silica and 0.3 parts of a hydrophobic titanium oxide using a Henshel mixer.

Thus, a comparative toner composition (1) was prepared.

Comparative Example 2

(Preparation of Toner Binder Resin)

In a reaction container having a condenser, a stirrer and a pipe from which a nitrogen gas was supplied to the container, 343 parts of an adduct of bisphenol A with 2 moles of ethyleneoxide, 166 parts of isophthalic acid and 2 parts of dibutyl tin oxide were mixed. Then the mixture was reacted for 8 hours at 230° C. under a normal pressure. Then the reaction was further performed for 5 hours under a reduced pressure of from 10 to 15 mmHg. Then the reaction product was cooled to 80° C. Then, toluene and 14 parts of tolylenediisocyanate were added thereto to perform a reaction at 110° C. for 5 hours. Then the solvent was removed therefrom. Thus a urethane-modified polyester resin was prepared.

On the other hand, 363 parts of an adduct of bisphenol A with 2 moles of ethyleneoxide and 166 parts of isophthalic acid were condensation-polymerized in the same way as performed in Example 1 to prepare an unmodified polyester resin.

Then 350 parts of the urethane-modified polyester resin prepared above and 650 parts of the unmodified polyester resin prepared above were dissolved in toluene. Then the solvent was removed therefrom to prepare a comparative toner binder resin (2).

(Preparation of Toner Composition)

One hundred (100) parts of the comparative toner binder resin (2), 2 parts of a chromium complex of salicylic acid (E-81 from Orient Chemical Industries Co., Ltd.) serving as a charge controlling agent, and 4 parts of a copper phthalocyanine blue pigment were mixed by a Henshel mixer, kneaded by a continuous kneader, pulverized by a jet pulverizer, and then classified by an air classifier.

One hundred (100) parts of the thus prepared mother toner particles were mixed with 0.3 parts of a hydrophobic silica and 0.3 parts of a hydrophobic titanium oxide using a Henshel mixer.

Thus, a comparative toner composition (2) was prepared.

Comparative Example 3

(Preparation of Toner Composition)

The following components were mixed for 10 hours using a ball mill.

| | |
|---|---|
| Polyester resin | 90 parts |

(a bisphenol type resin manufactured by Kao Corp. and having a number average molecular weight Mn of 6,000, a weight average molecular weight Mw of 70,000 and a glass transition temperature Tg of 64° C.)

| | |
|---|---|
| Carbon black (BP1300 from Cabot Corp.) | 10 parts |
| Rice wax (melting point of 82° C.) | 10 parts |
| Mixture solvent of diethyl ether and Dichloromethane at a weight ratio of 1/1 | 300 parts |

The thus prepared dispersion was added to 400 parts of a 2% aqueous solution of gum arabic, and the mixture was agitated by a HOMOMIXER for 3 minutes to prepare a dispersion. Then the dispersion was added to 2,000 parts of pure water. The mixture was heated to 80° C. in a water bath and agitated for 4 hours using a stirrer. Thus, irregular particles having an average particle diameter of 6.0 $\mu$m and having a recessed portion. The suspension was heated to 98° C. and maintained for 1 hour at the temperature to prepare mother toner particles.

The procedure for preparation of the toner composition in Example 1 was repeated except that mother toner particles were replaced with the mother toner particles prepared above.

Thus, a comparative toner composition (3) was prepared.

The details of the toner compositions of Examples 1 to 15 and comparative toner compositions of Comparative Examples 1 to 3 are shown in Tables 1-1 and 1-2.

TABLE 1-1

| | Toner binder resin (i) | Toner binder resin (ii) | Ratio of resin (i) to resin (ii) | Release agent | Amount of charge controlling agent |
|---|---|---|---|---|---|
| Ex. 1 | Urea-modified polyester (1) | Un-modified polyester (a) | 10/90 | Rice wax | 0.5 parts |
| Ex. 2 | Urea-modified polyester (2) | Un-modified polyester (b) | 20/80 | Rice wax | 0.25 parts |
| Ex. 3 | Urea-modified polyester (1) | Un-modified polyester (a) | 3/97 | Rice wax | 0.3 parts |
| Ex. 4 | Urea-modified polyester (1) | Un-modified polyester (a) | 50/50 | Rice wax | 0.3 parts |
| Ex. 5 | Urea-modified polyester (1) | Un-modified polyester (a) | 10/90 | Rice wax | 0.3 parts |
| Ex. 6 | Urea-modified polyester (1) | Un-modified polyester (b) | 10/90 | Rice wax | 0.6 parts |
| Ex. 7 | Urea-modified polyester (1) | Un-modified polyester (c) | 10/90 | Rice wax | 0.5 parts |
| Ex. 8 | Urea-modified polyester (1) | Un-modified polyester (d) | 10/90 | Rice wax | 0.5 parts |
| Ex. 9 | Urea-modified polyester (1) | Un-modified polyester (e) | 10/90 | Rice wax | 0.5 parts |
| Ex. 10 | Urea-modified polyester (2) | Un-modified polyester (f) | 10/90 | Rice wax | 0.4 parts |
| Ex. 11 | Urea-modified polyester (1) | Un-modified polyester (g) | 10/90 | Rice wax | 0.3 parts |
| Ex. 12 | Urea-modified polyester (1) | Un-modified polyester (h) | 10/90 | Rice wax | 0.5 parts |
| Ex. 13 | Pre-polymer (3) | Un-modified polyester (a) | 20.4/79.6 | Rice wax | 0.5 parts |
| Ex. 14 | Pre-polymer (4) | Un-modified polyester (a) | 23.5/76.5 | Rice wax | 0.5 parts |
| Ex. 15 | Pre-polymer (5) | Dead polymer (I) | 19.4/80.6 | Rice wax | 0.5 parts |
| Comp. Ex. 1 | — | Comp. Toner binder resin (1) | — | Rice wax | 0.5 parts |
| Comp. Ex. 2 | Urethane-modified polyester | Comp. Toner binder resin (2) | — | Rice wax | 0.5 parts |
| Comp. Ex. 3 | Solution suspension | Comp. Toner binder resin (3) | — | Rice wax | 0.5 parts |

TABLE 1-2

| | Mp | Percentage of components having Mw not less than 30,000 | Mn | Percentage of components having Mw not greater than 1,000 | Percentage of THF insoluble components | Acid value | Tg Of the binder resin (° C.) |
|---|---|---|---|---|---|---|---|
| Ex. 1 | 7000 | 3 | 4000 | 8 | 0 | 10 | 62 |
| Ex. 2 | 6500 | 4 | 6000 | 7 | 12 | 10 | 64 |
| Ex. 3 | 5000 | 2 | 2800 | 4 | 0 | 15 | 65 |
| Ex. 4 | 6000 | 10 | 4500 | 4 | 8 | 8 | 58 |
| Ex. 5 | 5000 | 3 | 3800 | 2 | 3 | 9 | 62 |
| Ex. 6 | 5000 | 4 | 4200 | 2 | 5 | 12 | 62 |
| Ex. 7 | 7000 | 4 | 4200 | 3 | 4 | 0.5 | 63 |
| Ex. 8 | 7000 | 4 | 4200 | 3 | 4 | 2 | 63 |
| Ex. 9 | 7000 | 3 | 5000 | 5 | 4 | 20 | 63 |
| Ex. 10 | 5000 | 5 | 4000 | 4 | 3 | 35 | 57 |
| Ex. 11 | 5000 | 3 | 5000 | 2 | 5 | 15 | 50 |
| Ex. 12 | 6000 | 6 | 4000 | 4 | 3 | 10 | 53 |
| Ex. 13 | 4000 | 3 | 4000 | 5 | 4 | 6 | 63 |
| Ex. 14 | 5600 | 5 | 3400 | 5 | 4 | 6 | 67 |
| Ex. 15 | 7500 | 4 | 4500 | 4 | 2 | 15 | 61 |
| Comp. Ex. 1 | 6000 | 0 | 4000 | 6 | 0 | 15 | 62 |
| Comp. Ex. 2 | 3800 | 0 | 3200 | 4 | 0 | 7 | 60 |
| Comp. Ex. 3 | 4000 | 2 | 6000 | 3 | 0 | 12 | 64 |

Evaluation Methods

1. Glass Transition Temperature (Tg)

In the present invention, the glass transition temperature was measured by a TG-DSC system TAS-100 manufactured by RIGAKU CORPORATION. The procedure for measurements of glass transition temperature is as follows:

(1) a sample of about 10 mg is contained in an aluminum container, and the container is set on a holder unit;

(2) the holder unit is set in an electrical furnace, and the sample is heated from room temperature to 150° C. at a temperature rising speed of 10° C./min;

(3) after the sample is allowed to settle at 150° C. for 10 minutes, the sample is cooled to room temperature;

(4) after the sample is allowed to settle at room temperature for 10 minutes; and (5) the sample is again heated under a nitrogen atmosphere from room temperature to 150° C. at a temperature rising speed of 10° C./min to perform a DSC measurement.

The glass transition temperature of the sample was determined using an analysis system of the TAS-100 system. Namely, the glass transition temperature is defined as the contact point between the tangent line of the endothermic curve at the temperatures near the glass transition temperature and the base line of the DSC curve.

2. Acid Value and Hydroxyl Value

The acid value and hydroxyl value were measured by methods based on JIS K0070. When the sample was not dissolved, dioxane or tetrahydrofuran was used as the solvent.

3. Fluidity of Powder (i.e., Toner Composition)

The bulk density of a toner composition was measured using a powder tester manufactured by HOSOKAWA MICRON CORPORATION. The larger the bulk density of a toner, the better fluidity the toner has. Fluidity is evaluated while classified into the following 4 grades:

◎: bulk density is not less than 0.35

○: bulk density is not less than 0.30 and less than 0.35

Δ: bulk density is not less than 0.25 and less than 0.30

: bulk density is less than 0.25

4. High Temperature Preservability

A toner sample was preserved at 50° C. for 8 hours. Then the toner sample was sieved for 2 minutes using a screen of 42 meshes to determine the weight ratio of the residue on the screen. High temperature preservability is evaluated while classified into the following four grades:

◎: weight ratio of the residue is less than 10%

○: weight ratio of the residue is not less than 10% and less than 20%

Δ: weight ratio of the residue is not less than 20% and less than 30%

: weight ratio of the residue is not less than 30%

5. Lower Fixable Temperature

Toner images were formed on a copy paper, TYPE 6200 from Ricoh Co., Ltd., using a copier, MF-200, which is manufactured by Ricoh Co., Ltd. and which uses a modified fixing unit having a fixing roller made of a polytetrafluoroethylene type fluorine-containing resin, while the fixing temperature is changed. The images were rubbed with a pad to determine the residual ratio of the image density of the images. The low temperature fixability of a toner is defined as the minimum value of the fixable temperature range of the toner images in which the toner images have a residual ratio of the image density not less than 70%.

6. Hot Offset Temperature

The above-prepared toner images were visually observed to determine whether there is hot offset image in the toner images. The hot offset temperature of a toner is defined as the minimum value of the fixing temperatures of the toner images having a hot offset image.

7. Glossing Temperature

Toner images were fixed using a fixing device of a marketed color copier, PRETER 550 manufactured by Ricoh Co., Ltd. while changing the temperature of the fixing roller. Gloss of the fixed toner images was measured by a gloss meter at an angle of 60°. The glossing temperature of a toner is defined as the minimum value of the fixing temperatures of the toner images having a gloss not less than 10%.

8. Haze Factor

A monochromatic image formed on an overhead projection sheet type PPC-DX manufactured by Ricoh Co., Ltd. The fixing temperature was 160° C. The haze factor of the cyan image was measured by a direct-reading type HAZE FACTOR COMPUTER HGM-2DP manufactured by Suga Test Instruments Co., Ltd.

The haze factor is called cloudiness, and the lower the haze factor of an image, the better the transparency of the image. The haze factor of a color image is preferably not greater than 30%, and more preferably not greater than 20%.

9. Charge Stability

Charge quantities (unit of $\mu c/g$) of a toner were measured by a blow-off method under low temperature/low humidity (10° C. 15% RH) and high temperature/high humidity (30° C. 90% RH) conditions to determine the charge variation of the toner. An iron powder coated with a silicone resin was used as the carrier. The charge variation (CV) is defined by the following equation:

$$CV=\{(QL-QH)/QL\}\times 100\ (\%)$$

wherein QL represents the charge quantity of the toner at 10° C. 15% RH, and QH represents the charge quantity of the toner at 30° C. 90% RH. The charge stability of a toner is evaluated while classified into the following four grades:

⊙: charge variation is not-greater than 20%

○: charge variation is not greater than 50%

Δ: charge variation is not greater than 80%

: charge variation is greater than 80%

10. Image Qualities

Each of the toners of Examples 1 to 15 and Comparative Examples 1 to 3 was set in a color copier, IMAGIO COLOR 4000, and images were produced. The image qualities of the images and transferability of the toner were visually evaluated.

The results are shown in Tables 2-1, 2–2 and 3.

TABLE 2-1

| | Specific surface area ($m^2/g$) | Volume average particle diameter ($\mu m$) | Dv/Dn | Percentage of particles of 3 $\mu m$ or less (% by number) | Spherical degree |
|---|---|---|---|---|---|
| Ex. 1 | 1.45 | 8.0 | 1.10 | 5.0 | 0.960 |
| Ex. 2 | 1.08 | 7.5 | 1.15 | 6.0 | 0.985 |
| Ex. 3 | 0.85 | 6.5 | 1.06 | 5.5 | 0.970 |
| Ex. 4 | 2.20 | 7.0 | 1.20 | 8.5 | 0.980 |
| Ex. 5 | 1.90 | 8.0 | 1.10 | 6.5 | 0.970 |
| Ex. 6 | 1.55 | 5.0 | 1.12 | 7.0 | 0.965 |
| Ex. 7 | 1.25 | 7.5 | 1.11 | 8.5 | 0.980 |
| Ex. 8 | 1.15 | 6.0 | 1.08 | 6.8 | 0.965 |
| Ex. 9 | 1.95 | 7.5 | 1.09 | 8.5 | 0.970 |
| Ex. 10 | 1.25 | 8.0 | 1.15 | 5.5 | 0.975 |
| Ex. 11 | 0.95 | 5.5 | 1.12 | 8.6 | 0.975 |
| Ex. 12 | 2.10 | 8.0 | 1.15 | 6.8 | 0.970 |
| Ex. 13 | 1.85 | 5.5 | 1.09 | 8.6 | 0.985 |
| Ex. 14 | 1.25 | 4.9 | 1.13 | 8.9 | 0.980 |
| Ex. 15 | 1.65 | 6.2 | 1.14 | 9.2 | 0.970 |
| Comp. Ex. 1 | 1.20 | 7.0 | 1.25 | 8.5 | 0.98 |
| Comp. Ex. 2 | 3.50 | 7.5 | 1.30 | 15.0 | 0.91 |
| Comp. Ex. 3 | 2.60 | 6.0 | 1.15 | 11.5 | 0.94 |

TABLE 2-2

| | Lower fixable temperature (° C.) | Gloss (° C.) | Hot offset (° C.) | Charge stability | Haze factor | High temperature preservability | Fluidity |
|---|---|---|---|---|---|---|---|
| Ex. 1 | 155 | 160 | 200 | ○ | ○ | ○ | ⊙ |
| Ex. 2 | 145 | 170 | 210 | ○ | ○ | ○ | ○ |
| Ex. 3 | 150 | 160 | 200 | ○ | ○ | ○ | ○ |
| Ex. 4 | 155 | 170 | 230 | ○ | ○ | ⊙ | ○ |
| Ex. 5 | 145 | 180 | 230 | ○ | ○ | ⊙ | ○ |
| Ex. 6 | 160 | 180 | 240 | ○ | Δ | ○ | Δ |
| Ex. 7 | 145 | 180 | 220 | ○ | Δ | ○ | ○ |
| Ex. 8 | 140 | 150 | 220 | ○ | Δ | ○ | ○ |
| Ex. 9 | 155 | 160 | 220 | ○ | ○ | ○ | ○ |
| Ex. 10 | 155 | 160 | 210 | ○ | ○ | ○ | ○ |
| Ex. 11 | 155 | 160 | 210 | ○ | ○ | Δ | ○ |
| Ex. 12 | 150 | 160 | 220 | ○ | ○ | Δ | ○ |
| Ex. 13 | 150 | 150 | 220 | ○ | Δ | ○ | ○ |
| Ex. 14 | 160 | 160 | 230 | ○ | Δ | ○ | Δ |
| Ex. 15 | 140 | 160 | 220 | ○ | ○ | ○ | ○ |
| Comp. Ex. 1 | 155 | 160 | 170 | ○ | ○ | ○ | Δ |
| Comp. Ex. 2 | 155 | 160 | 170 | | ○ | ○ | |
| Comp. Ex. 3 | 160 | 150 | 180 | ○ | | ○ | |

TABLE 3

| | Transferability (%) | Image qualities |
|---|---|---|
| Ex. 1 | 97 | Good |
| Ex. 2 | 99 | Good |
| Ex. 3 | 98 | Good |
| Ex. 4 | 99 | Good |
| Ex. 5 | 98 | Good |
| Ex. 6 | 97 | Good |
| Ex. 7 | 99 | Good |
| Ex. 8 | 98 | Good |
| Ex. 9 | 98 | Good |
| Ex. 10 | 98 | Good |
| Ex. 11 | 99 | Good |
| Ex. 12 | 98 | Good |
| Ex. 13 | 99 | Good |
| Ex. 14 | 99 | Good |
| Ex. 15 | 99 | Good |
| Comp. Ex. 1 | 98 | — |
| Comp. Ex. 2 | 91 | Image density decreased after 30,000 copies were produced because the charge quantity of the toner decreased. |
| Comp. Ex. 3 | 97 | Black spots were produced in the images because the additive released from the toner particles. |

In addition, the cyan color toner of Example 1, and magenta, yellow and black toners, which were prepared in the same way as performed in Example 1 except that the colorant was changed as described below, were set in the color image forming apparatus having a configuration as illustrated in FIG. 2 to perform a copying test in which 10,000 copies were formed while the fixing temperature was set to the standard fixing temperature.

Colorant

Magenta: a quinacridone type magenta colorant

Yellow: a disazo yellow type pigment

Black: a carbon black (#44 manufactured by Mitsubishi Chemical Corp.)

The spherical degree of the color toners are as follows:

Magenta toner: 0.975

Yellow toner: 0.970

Black toner: 0.965

As a result of the running test, color images having high resolution and high gloss were produced during the running test. In addition, the fixing device of the apparatus was not contaminated even after the running test.

This document claims priority and contains subject matter related to Japanese Patent Application No. 2001-285326, filed on Sep. 19, 2001, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. Toner particles comprising:

mother toner particles comprising:

a binder resin;

a colorant; and a release agent; and a charge controlling agent located on a surface of the mother toner particles and fixed thereon, wherein the toner particles have a spherical degree of from 0.960 to 1.000 and a specific surface area of from 0.70 to 2.5 $m^2/g$.

2. The toner particles according to claim 1, wherein the toner particles have a volume average particle diameter (Dv) of from 3.0 to 8.0 $\mu$m, and satisfy the following relationship:

$$1.00 \leqq Dv/Dn \leqq -1.20,$$

wherein Dv represents the volume average particle diameter of the toner particles and Dn represents a number average particle diameter of the toner particles.

3. The toner particles according to claim 1, wherein the binder resin comprises a polyester resin in an amount greater than an amount of any of other resins included in the mother toner particles as binder resin.

4. The toner particles according to claim 3, wherein the polyester resin has a glass transition temperature of from 55 to 75° C. and an acid value of from 1 to 30 mgKOH/g.

5. A toner composition comprising:

the toner particles of claim 1, and an external additive other than a charge controlling agent present on at least a surface of the toner particles.

6. The toner composition according to claim 5, wherein the toner composition has a volume average particle diameter (Dv) of from 3.0 to 8.0 $\mu$m, and satisfies the following relationship:

$$1.01 \leqq Dv/Dn \leqq 1.20,$$

wherein Dv represents the volume average particle diameter of the toner composition and Dn represents a number average particle diameter of the toner composition.

7. A method for manufacturing toner particles, comprising:

reacting a prepolymer having an isocyanate group with an amine in an aqueous liquid comprising at least one of an inorganic dispersant and a particulate polymer to perform an elongation reaction and a crosslinking reaction of the prepolymer and to prepare a urea-modified polyester resin;

dissolving at least the urea-modified polyester resin in an organic solvent to prepare a binder resin solution;

dispersing at least the binder resin solution, a colorant and a release agent in an aqueous liquid to prepare a dispersion;

removing at least the organic solvent and aqueous liquid from the dispersion to prepare mother toner particles; and fixing a charge controlling agent on a surface of the mother toner particles to prepare toner particles, wherein the toner particles have a spherical degree of from 0.960 to 1.000 and a specific surface area of from 0.70 to 2.5 $m^2/g$.

8. The method according to claim 7, further comprising:

mixing an external additive with the toner particles to prepare a toner composition.

9. The method according to claim 7, wherein the dissolving comprises:

dissolving the urea-modified polyester resin and another binder resin in an organic solvent to prepare a binder resin solution.

10. The method according to claim 9, wherein the another binder resin is an unmodified polyester resin.

11. A method for manufacturing toner particles, comprising:

mixing at least a prepolymer having an isocyanate group, an amine, an organic solvent, a release agent and a colorant to prepare a mixture;

dissolving the mixture in an aqueous liquid to prepare a dispersion;

reacting the prepolymer with the amine in the dispersion;

removing at least the organic solvent and aqueous liquid from the dispersion to prepare mother toner particles;

fixing a charge controlling agent on a surface of the mother toner particles to prepare toner particles, wherein the toner particles have a spherical degree of from 0.960 to 1.000 and a specific surface area of from 0.70 to 2.5 $m^2/g$.

12. The method according to claim 11, further comprising:

mixing an external additive with the toner particles to prepare a toner composition.

13. The method according to claim 11, wherein the mixing comprises:

mixing at least a prepolymer having an isocyanate group, a binder resin, an amine, an organic solvent, a release agent and a colorant to prepare a mixture.

14. The method according to claim 13, wherein the binder resin is an unmodified polyester resin.

15. An image forming apparatus comprising:

an image bearing member;

a charger configured to charge the image bearing member;

a light irradiator configured to irradiate the image bearing member with light to form a latent image on the image bearing member;

an image developer configured to develop the latent image with a developer including a toner to form a toner image on the image bearing member;

a transfer device configured to transfer the toner image on the image bearing member to a receiving material optionally via an intermediate transfer medium; and a fixer configured to fix the toner image on the receiving material, wherein the toner comprises:

mother toner particles comprising:

a binder resin, a colorant, and a release agent; and a charge controlling agent located on a surface of the mother toner particles and fixed thereon, wherein the toner particles have a spherical degree of from 0.960 to 1.000 and a specific surface area of from 0.70 to 2.5 $m^2/g$.

16. The image forming apparatus according to claim 15, wherein the toner particles further comprise:

an external additive other than a charge controlling agent present on at least a surface of the toner particles.

17. The image forming apparatus according to claim 16, wherein the toner particles have a volume average particle diameter (Dv) of from 3.0 to 8.0 $\mu$m, and satisfies the following relationship:

$$1.01 \leqq Dv/Dn \leqq 1.20,$$

wherein Dv represents the volume average particle diameter of the toner particles and Dn represents a number average particle diameter of the toner particles.

18. The image forming apparatus according to claim 15, wherein the toner particles have a volume average particle diameter (Dv) of from 3.0 to 8.0 $\mu$m, and satisfies the following relationship:

$$1.03 \leqq Dv/Dn \leqq 1.20,$$

wherein Dv represents the volume average particle diameter of the toner particles and Dn represents a number average particle diameter of the toner particles.

19. The image forming apparatus according to claim 15, wherein the binder resin comprises a polyester resin in an amount greater than an amount of any of other resins included in the mother toner particles as the binder resin.

20. The image forming apparatus according to claim 18, wherein the polyester resin has a glass transition temperature of from 55 to 75° C and an acid value of from 1 to 30 mgKOH/g.

21. Toner particles comprising:

mother toner particles comprising:

a binder resin, a colorant, and a release agent; and a charge controlling agent located on a surface of the mother toner particles and fixed thereon;

wherein the toner particles have a spherical degree of from 0.960 to 1.000 and a specific surface area of from 0.70 to 2.5 $m^2/g$, wherein the specific surface area of the toner particles falls within 110% of the specific surface area of the mother toner particles.

* * * * *